US008215268B2

(12) United States Patent
Barberato

(10) Patent No.: US 8,215,268 B2
(45) Date of Patent: Jul. 10, 2012

(54) THREE-STROKE INTERNAL COMBUSTION ENGINE, CYCLE AND COMPONENTS

(76) Inventor: Claudio Barberato, Osasco (BR)

( * ) Notice: Subject to any disclaimer, the term of this patent is extended or adjusted under 35 U.S.C. 154(b) by 769 days.

(21) Appl. No.: 12/339,270

(22) Filed: Dec. 19, 2008

(65) Prior Publication Data

US 2010/0154749 A1 Jun. 24, 2010

(51) Int. Cl.

| | |
|---|---|
| ***F01B 7/00*** | (2006.01) |
| ***F01B 7/02*** | (2006.01) |
| ***F01B 7/16*** | (2006.01) |
| ***F02B 75/28*** | (2006.01) |
| ***F02B 75/32*** | (2006.01) |

(52) U.S. Cl. ..... 123/51 R; 123/48 C; 123/197.1; 123/197.2

(58) Field of Classification Search ..... 123/48 C, 123/51 R

See application file for complete search history.

(56) References Cited

U.S. PATENT DOCUMENTS

| | | | | |
|---|---|---|---|---|
| 1,679,766 | A * | 8/1928 | Friend et al. | 123/41.35 |
| 3,340,858 | A * | 9/1967 | Gerin | 123/78 C |
| 3,961,607 | A | 6/1976 | Brems | |
| 3,996,903 | A * | 12/1976 | Cseh | 123/74 AA |
| 4,079,705 | A | 3/1978 | Buchner | |
| 4,096,835 | A | 6/1978 | Lamont | |
| 4,104,995 | A | 8/1978 | Steinbock | |
| 4,237,831 | A | 12/1980 | Noguchi et al. | |
| 4,565,165 | A | 1/1986 | Papanicolaou | |
| 4,602,596 | A | 7/1986 | Kessler | |
| 4,934,344 | A | 6/1990 | Perr | |
| 5,050,570 | A * | 9/1991 | Thring | 123/556 |
| 5,056,471 | A | 10/1991 | Van Husen | |
| 5,454,352 | A | 10/1995 | Ward | |
| 5,542,382 | A | 8/1996 | Clarke | |
| 5,560,326 | A | 10/1996 | Merritt | |
| 5,596,955 | A | 1/1997 | Szuba | |
| 5,713,314 | A | 2/1998 | Beare | |
| 5,857,450 | A * | 1/1999 | Staerzl | 123/65 S |
| 5,934,228 | A * | 8/1999 | Wheat | 123/48 C |
| 6,457,309 | B1 * | 10/2002 | Firey | 60/517 |
| 6,568,357 | B1 | 5/2003 | Rao et al. | |
| 6,578,533 | B1 | 6/2003 | Gray, Jr. | |
| 6,722,322 | B2 * | 4/2004 | Tse | 123/46 A |
| 7,159,544 | B1 | 1/2007 | Studdert et al. | |
| 2002/0159902 | A1 * | 10/2002 | Beaudoin | 417/490 |

FOREIGN PATENT DOCUMENTS

| | | |
|---|---|---|
| FR | 2540181 | 8/1984 |
| WO | 2006/060859 | 6/2006 |

OTHER PUBLICATIONS

S. L. Maleev, Internal Combustion Engine (Mc Graw Hill, 1945) 17.

* cited by examiner

*Primary Examiner* — Noah Kamen
*Assistant Examiner* — Grant Moubry
(74) *Attorney, Agent, or Firm* — McCormick, Paulding & Huber LLP

(57) ABSTRACT

A three-stroke internal combustion engine completes a complete combustion cycle of exhaust, intake, compression, ignition, and expansion within a single revolution of a crankshaft by a single stroke of a first piston and a single stroke of a second piston within a single cylinder.

10 Claims, 20 Drawing Sheets

THREE-STROKE INTERNAL COMBUSTION ENGINE, CYCLE AND COMPONENTS

FIELD OF THE INVENTION

The present invention relates to internal combustion engines and, more particularly, to overexpanded (Atkinson cycle) internal combustion engines.

BACKGROUND OF THE INVENTION

Since the first practical applications of the Otto and Diesel cycles in internal combustion engines, engineers the world over have struggled to improve the power-to-weight ratio and/or fuel efficiency of such engines. Frequently, designers have considered alternatives or modifications to the standard four-stroke engine cycles. For example, in small engines a two-stroke cycle may be used to increase the power-to-weight ratio. However, the two-stroke cycle actually tends to reduce fuel efficiency and also tends to produce undesirable chemical byproducts of partial fuel and lubrication oil combustion.

As one example of prior art attempts to improve the internal combustion engine, U.S. Pat. No. 6,209,495 discloses a two stroke compound engine that has a pair of horizontally opposed piston cylinder assemblies extending along a common axis therein. Each piston cylinder assembly includes a piston, a combustion chamber and respective inlet and exhaust valves. A pair of connecting rods extending along the common axis connect the respective pistons to a crank extending from a rotary housing. The rotary housing is rotatably mounted within the engine and includes an output shaft extending co-axially therefrom. A fixed ring gear is mounted co-axially about the rotary housing along an axis extending perpendicularly to the common axis. A planetary gear mounted on the crank meshes with the ring gear for rotating the rotatable housing in response to reciprocation of the pistons. A pair of combustors are mounted on exhaust ports of the respective piston assemblies for further combusting exhaust from the combustion chambers by mixing exhaust with cooling air and additional fuel. A turbine recovers power from the combustion within the combustors. The turbine is connected to the output shaft by a gearing mechanism and an overrunning clutch mechanism.

As another example selected from the thousands of modifications proposed to the well-known four-stroke engine cycle, U.S. Pat. No. 6,722,322 discloses an internal combustion engine including an engine cylinder that includes a cylinder cavity with first and second cylinder heads. A single piston member is slidably movable within the cylinder cavity between the first and second heads to partition the cavity into first and second combustion chambers, which are in alternate combustion in normal engine operation.

As yet another example of previous efforts, U.S. Pat. No. 4,934,344 discloses an internal combustion engine with a modified four stroke cycle which takes place during a single revolution of a crankshaft having first and second cam lobes, which drive a reciprocating piston via a connecting rod pivotally connected to a guide link driven by a camshaft. In the modified four stroke cycle of the '344 patent, the single piston moves through short duration compression and power strokes, then through relatively long duration exhaust and intake strokes.

BRIEF SUMMARY OF THE INVENTION

By contrast to the prior art, according to the present invention, a complete combustion cycle is completed in a single revolution of a combined crankshaft/camshaft driving and driven by two co-reciprocating pistons housed in a single cylinder.

In one aspect of the present invention, a three-stroke internal combustion engine has first and second pistons. The pistons are movably connected to a single crankshaft for reciprocating motion toward and away from each other within a single cylinder during a single revolution of the crankshaft. During the single revolution of the crankshaft, the pistons mutually accomplish an exhaust/intake stroke, a compression stroke, and an expansion stroke. The cylinder has a first open end near the crankshaft and has inlet ports near the first end. The second end of the cylinder is closed by a head. The head includes an exhaust passage. The cylinder contains an intake chamber between the two pistons and a combustion chamber between the second piston and the cylinder head. During at least a part of the exhaust-intake stroke, the exhaust passage is open to said combustion chamber; the crankshaft causes the second piston to move toward the head, exhausting burned gases from the combustion chamber. During at least another part of the exhaust-intake stroke, the crankshaft causes the first piston to move away from the second piston, opening the inlet ports to the intake chamber so as to aspirate an air-fuel mixture into the intake chamber. During the compression stroke, the exhaust passage and the inlet ports are closed, and the crankshaft causes the first piston to move toward the second piston, forcing the air-fuel mixture past the second piston into the combustion chamber. While the exhaust passage and the inlet ports remain closed, the air-fuel mixture is ignited to form burning gases. The burning gases expand in the combustion chamber, causing motion of the pistons away from the head. At least the first piston is so coupled to the crankshaft as to cause the crankshaft to move through the expansion stroke. The exhaust-intake stroke follows the expansion stroke.

In another aspect of the present invention, a three-stroke internal combustion engine includes an intake manifold, opposed journals rigidly connected to the intake manifold, a cylinder mounted to the inner wall of the intake manifold, a head mounted to the cylinder, a crankshaft rotatably mounted in the journals, a connecting rod, a first piston, a second piston, and a cam follower base. The inlet manifold includes an inner wall defining inlet ports. The journals define a crankshaft axis about which the crankshaft rotate. The cylinder has an inner surface extending from a first open end adjacent the intake manifold to a second end closed by the head. Bypass channels are formed near the second end of the cylinder inner surface. The head includes an exhaust passage with an exhaust valve mounted in the passage. The crankshaft includes a crank surface in registration with the cylinder axis and also includes a cam substantially adjacent to the crank surface. The connecting rod has upper and lower ends joined by a web. The lower end of the connecting rod is pivotally connected to the crank surface. The upper end of the connecting rod is pivotally connected to the first piston. The first piston is slidably movable within the cylinder along the cylinder axis. The first piston and the head define a compression chamber within the cylinder. The first piston includes holes extending substantially parallel to the cylinder axis from the compression chamber through the first piston. The second piston is connected to the cam follower base by push rods extending through the holes of the first piston. The first and second pistons define an intake chamber within the cylinder. Rotation of the crankshaft causes revolution of the crank surface and the cam about the crankshaft axis. The crank surface, via the connecting rod, causes the first piston to move toward the head during a compression stroke. The cam follower base, via the push rods, causes the second piston to move toward the head during an exhaust-intake stroke. The first piston, via the connecting rod, causes the crank surface to revolve during an expansion stroke. The second piston moves with the first piston during at least a part of the expansion stroke. Preferably, the first piston supports the second piston during the totality of the expansion stroke.

In another aspect of the present invention, mechanical power is obtained from cyclic combustion of an air-fuel mixture. The air-fuel mixture is aspirated into an intake chamber through a first opening while burned gases are expelled from an adjacent combustion chamber through a second opening. The first and second openings then are closed, and the air-fuel mixture is forced from the intake chamber to the combustion chamber. After igniting the air-fuel mixture in the combustion chamber, the burning gases are permitted to expand the combustion chamber, thereby producing mechanical power from the combustion of the air-fuel mixture.

These and other objects, features and advantages of the present invention will become apparent in light of the detailed description of the best mode embodiment thereof, as illustrated in the accompanying drawings.

DETAILED DESCRIPTION OF PREFERRED EMBODIMENTS

Figure 8:
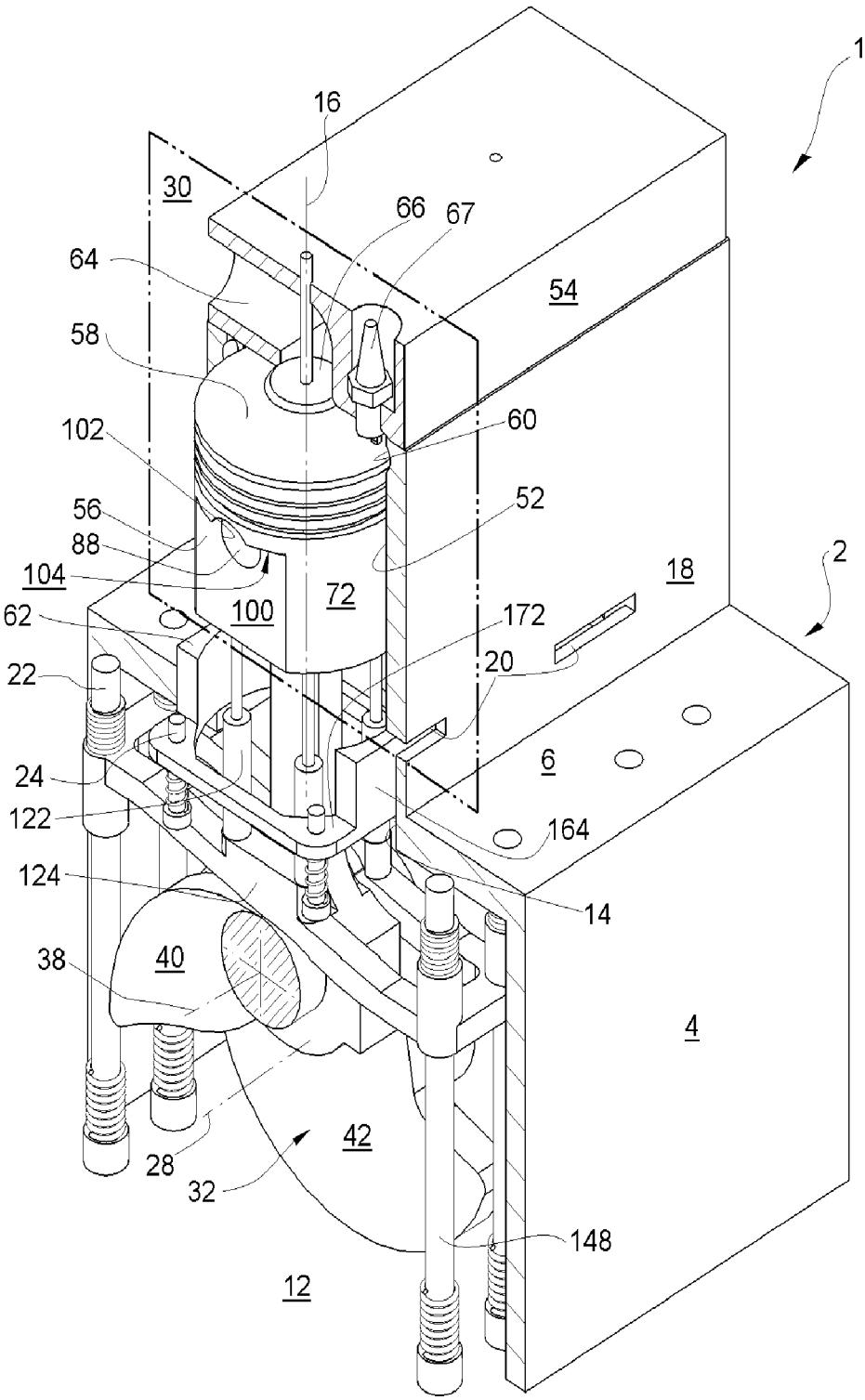
FIG. 8 is a perspective section view of a three-stroke engine, according to an embodiment of the present invention, at a crankshaft rotation angle θ=0°.

Referring to FIG. 8, in a first embodiment of the present invention, a three-stroke internal combustion engine 1 is spark-ignited. The three-stroke engine includes a block 2 having side walls 4, an upper wall 6, a bottom wall (not shown) opposing the upper wall, and parallel opposing end walls (not shown). The walls of the block enclose a sump 12. The upper wall has first and second cylinder openings 14 formed therein, each opening being symmetric about a corresponding cylinder axis 16. An intake manifold inner wall 18, having inlet ports 20 formed therein, extends upward from the block upper wall around the cylinder openings. Guide rods 22 and valve pins 24 are disposed around each cylinder opening, and extend from the block upper wall toward the bottom wall. The end walls have shaft journals (not shown) formed therein, the shaft journals defining a crankshaft axis 28 that substantially perpendicularly intersects the cylinder axes. Cylinder planes 30 pass through each cylinder axis substantially perpendicular to the crankshaft axis.

Figure 5:
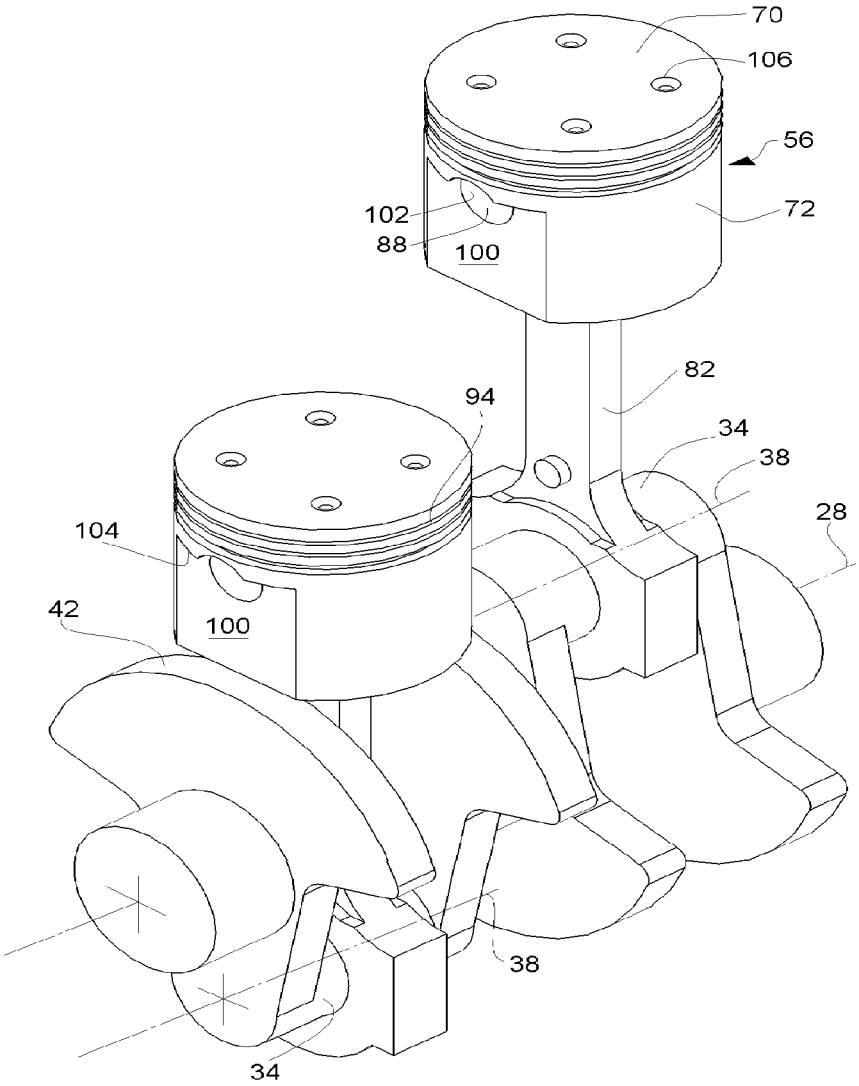
FIG. 5 is a perspective view of an expansion-compression piston/connecting rod/crankshaft assembly according to an embodiment of the present invention.
Figure 7:
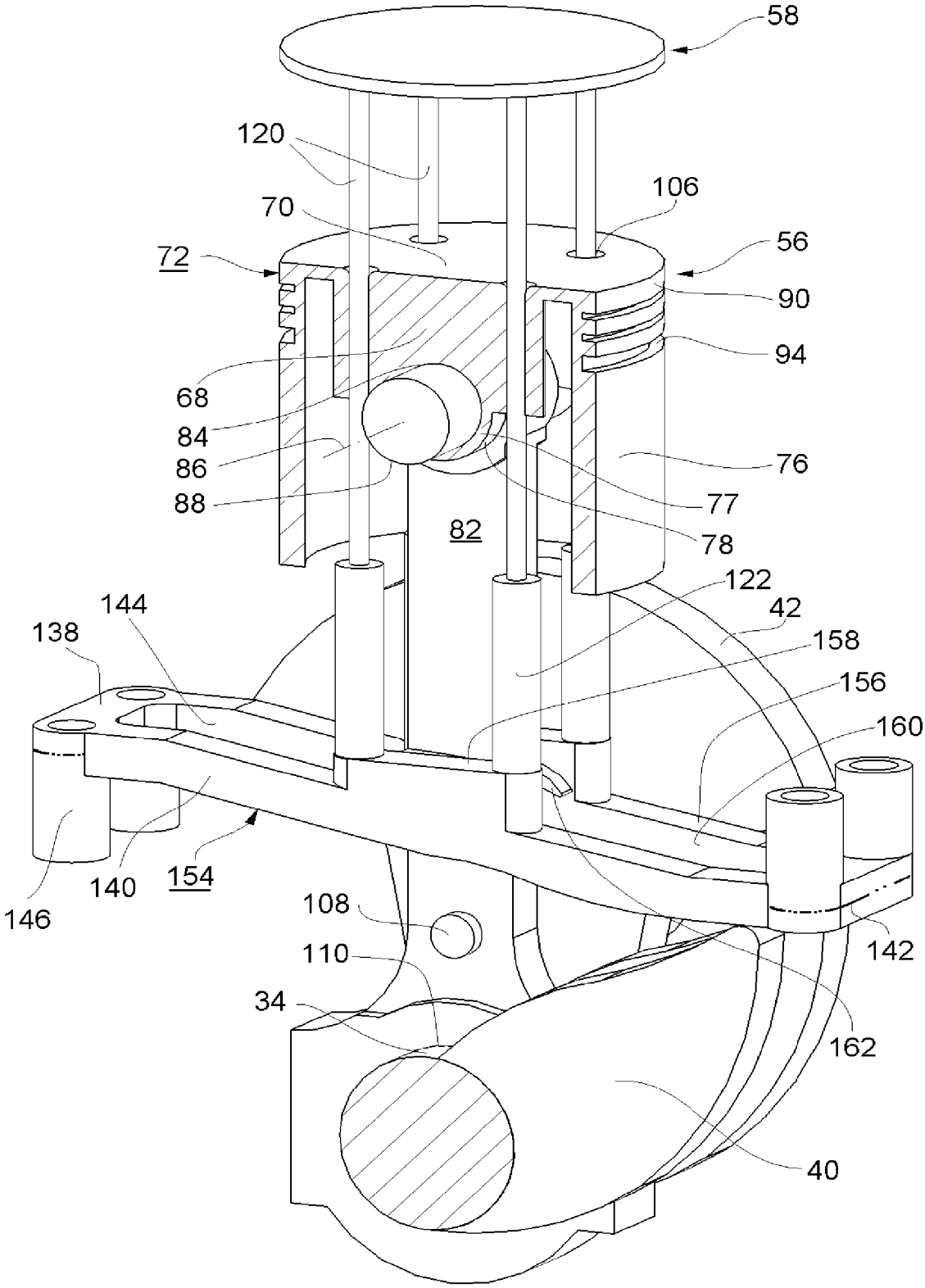
FIG. 7 is a perspective partial sectioned view of the components of FIGS. 5 and 6 assembled together according to an embodiment of the present invention.

A crankshaft 32 is mounted in the shaft journals for revolution about the crankshaft axis. Referring to FIG. 5, the crankshaft includes two substantially circular crank surfaces 34, each crank surface defining a midplane substantially in registration with a corresponding cylinder plane, and defining a cranking axis 38 parallel to and radially offset from the crankshaft axis. For example, each cranking axis is offset from the crankshaft axis at a cranking radius (a) of 5.3 cm. Referring to FIG. 7, the crankshaft also includes a pair of cams 40 corresponding to each crank surface, and counterweights 42 that are axially and radially offset from corresponding crank surfaces, as known to those of ordinary skill.

Figure 9:
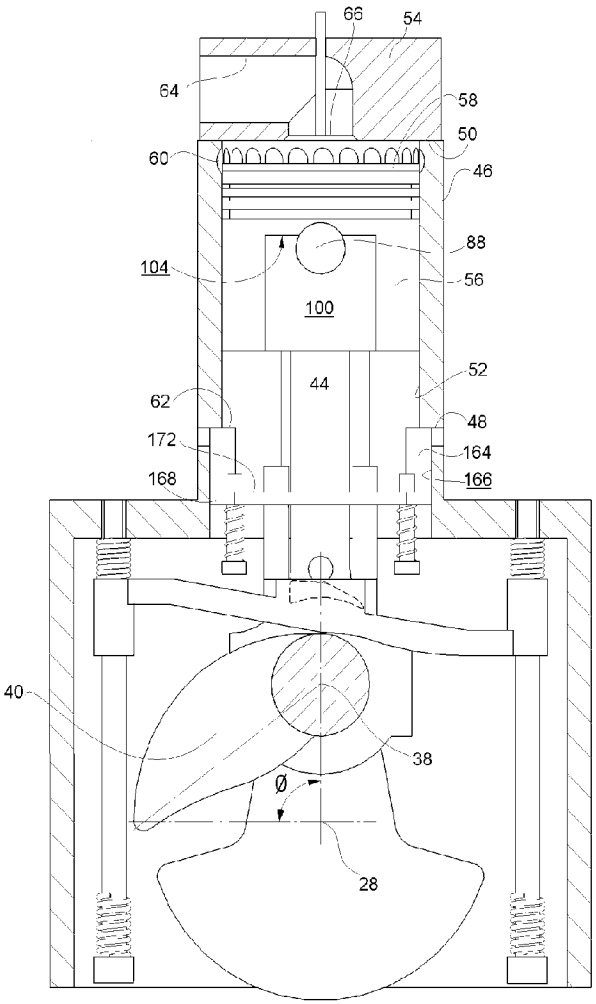
FIG. 9 is a normal section view of the engine of FIG. 8.

Each pair of cams substantially symmetrically axially brackets the corresponding crank surface. The cams are substantially circumaxial with the corresponding cranking axis. Referring to FIG. 9, the furthest radial protrusion of each cam from the crankshaft axis is angularity offset from the corresponding cranking axis by a timing angle Ø, preferably ninety (90) degrees, that is measured around the crankshaft axis in the corresponding midplane.

Referring to FIGS. 8 and 9, two cylinders 44 are rigidly mounted to the upper wall of the block. Each cylinder includes a cylinder wall 46 extending between a first end surface 48 adjoining the intake manifold, and a second end surface 50 distant from the intake manifold. The cylinder wall of each cylinder defines an inner surface 52 that is substantially circumaxial with the corresponding cylinder axis, so that the first end surface is substantially in registration with, and partially occludes, a corresponding one of the cylinder openings formed in the block upper wall. The second end surface of each cylinder abuts on a cylinder head 54, which seals the cylinder.

Each cylinder houses a first piston, hereinafter referred to as the expansion-compression piston 56, and a second piston, hereinafter referred to as the exhaust-intake piston 58. The expansion-compression piston and the exhaust-intake piston are slidingly reciprocally movable within the cylinder. For example, as shown in FIG. 9, the expansion-compression and exhaust-intake pistons each have a bore (B) of eight (8) cm.

Referring back to FIG. 8, bypass channels 60, extending substantially parallel to the cylinder axis, are formed in the cylinder wall near the cylinder head. The cylinder walls may also include cooling means (not shown) as known in the art. Each cylinder also partly houses a slide valve 62 disposed at the first end of the cylinder and supported on the valve pins for sliding motion along the cylinder axis.

Still referring to FIG. 8, the cylinder head includes an exhaust passage 64, in which an exhaust valve 66 is disposed for motion between a sealing position and a venting position. The cylinder head also includes an igniter 67. The cylinder head also supports means (not shown) for operating the exhaust valve according to the rotation angle of the crankshaft, the fuel/air mixture ratio, the crankshaft torque loading, and/or other variables known to those of ordinary skill. For example, the exhaust valve may be operated by analog or digital solenoid, by valve rocker cam, by hydraulic or pneumatic piston, or by similar conventional means. The cylinder head may also include cooling means (not shown) as known in the art.

Referring now to FIGS. 5 and 7, the expansion-compression piston includes a body 68, a disc-shaped head 70 disposed at an upper surface of the body, and a cylindrical skirt 72 extending from a lower surface of the head around the body.

The expansion-compression piston body includes a yoke 77 defining a slot 78, which is symmetric about an expansion-compression piston midplane containing the expansion-compression piston axis. Wrist pin holes 84 defining a wrist axis 86 are formed in the body, substantially perpendicular to the cylinder plane and intersecting the inner slot. An upper end of a connecting rod 82, having a second wrist pin hole, is received in the slot. A wrist pin 88 is inserted through the wrist pin holes to pivotally fasten the expansion-compression piston body to the upper end of the connecting rod.

The outer circumferential surface of the expansion-compression piston head is configured to closely fit within the inner surface of the cylinder wall for sliding motion of the expansion-compression piston within the cylinder. The piston skirt has an upper axial portion of substantially circular axial cross section and substantially uniform radial thickness, joined to the lower surface of the head and having an outer circumferential surface substantially continuous with the outer circumferential surface of the head. Circumferential grooves 94 can be formed in the outer circumferential surface of the skirt upper portion for receiving piston rings (not shown). The piston skirt also has a lower axial portion, having an axial cross-section of substantially uniform radial thickness wherein two opposing chord segments 100 interrupt the outer circumferential surface of the skirt. The two opposing chord segments are substantially parallel to, and symmetrically offset from, the expansion-compression piston midplane. The transition from the upper axial portion to the lower axial portion of the expansion-compression piston skirt defines two radial shoulders 104 lying in a plane substantially perpendicular to the expansion-compression piston axis. The radial shoulders interact with the slide valve as explained in further detail below.

Opposing clearance holes 102 are formed in the chord segments, substantially coaxial with the wrist pin holes, for assembling the wrist pin. Four holes 106 are formed in the expansion-compression piston head, extending from an upper surface of the piston head entirely through the piston body.

The upper end of the connecting rod is fastened to the expansion-compression piston body by the wrist pin for oscillation about the wrist axis. The connecting rod also includes a lower end, a web extending between the upper and lower ends, and two small cylinders 108 protruding substantially perpendicularly from opposed side surfaces of the web. In one variation of this first embodiment of the present invention, the connecting rod has a length (r) of seventeen (17) cm. The lower end of the connecting rod is secured to the crank surface for oscillation about the cranking axis, as known in the art.

Figure 4:
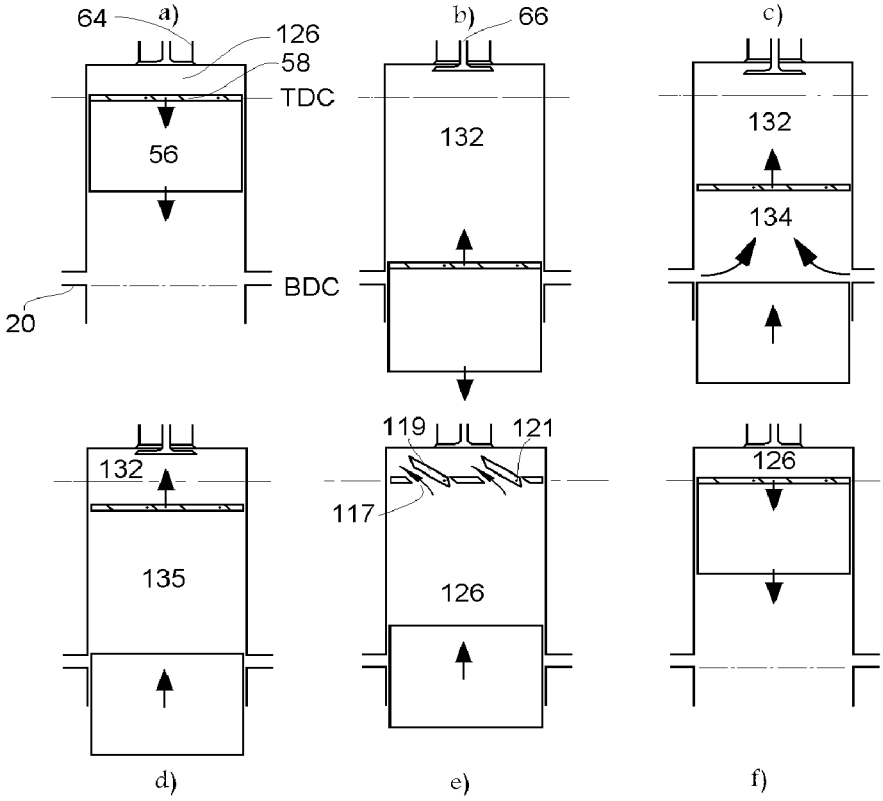
FIG. 4 is a schematic illustration of a three-stroke combustion cycle showing inlet ports in an exhaust-intake piston of an engine according to another embodiment of the present invention.
Figure 6:
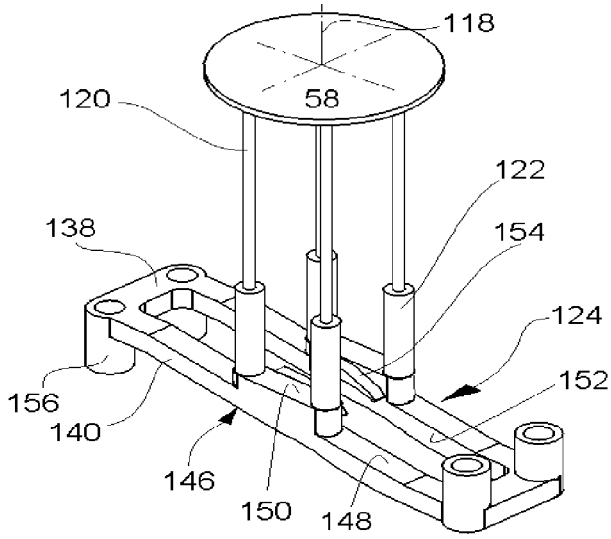
FIG. 6 is a perspective view of an exhaust-intake piston according to an embodiment of the present invention.

Referring to FIGS. 6 and 7, the exhaust-intake piston includes a disc having upper and lower surfaces and having an outer surface defining an exhaust-intake piston axis 118. The outer surface of the exhaust-intake piston is configured to closely fit within the inner surface of the cylinder wall for sliding motion along the cylinder wall. The lower surface of the exhaust-intake piston includes four holes for receiving piston ends of four exhaust-intake piston push rods 120. As shown in FIG. 4, the exhaust-intake piston can also include one or more inlet valve holes 117 housing bypass check valves 119. The bypass check valves can be hingedly connected to the piston by hinge pins 121.

Referring back to FIGS. 6-8, the exhaust-intake piston is disposed within the cylinder between the expansion-compression piston body and the cylinder head, such that the push rods extend from the lower surface of the exhaust-intake piston through the expansion-compression piston body holes. Each push rod is slidably movable through the corresponding expansion-compression piston body hole, and has a base end opposite the piston end. The base ends of the push rods are rigidly connected to push rod sockets 122 fixedly attached to a cam follower base 124 corresponding to the cylinder. For example, the push rods can be pinned to the push rod sockets.

As each crank surface revolves around the crankshaft axis, the corresponding connecting rod causes the corresponding expansion-compression piston to reciprocate within the corresponding cylinder. Referring to FIGS. 1-3, 11, and 18, while the exhaust valve and the inlet ports for that cylinder are closed, the upper surface of the expansion-compression piston, the cylinder inner surface, and the lower surface of the cylinder head define a compression/combustion chamber 126. At the closest approach of the expansion-compression piston to the cylinder head, the upper surface of the expansion-compression piston defines a Top Dead Center plane TDC, as shown in FIG. 9. At the furthest retreat of the expansion-compression piston from the cylinder head, the upper surface of the expansion-compression piston defines a Bottom Dead Center plane BDC.

As each pair of cams revolves around the crankshaft axis, the corresponding cam follower base and push rods cause the corresponding exhaust-intake piston to reciprocate within the corresponding cylinder.

Referring to FIGS. 1-4, while the exhaust passage for that cylinder is vented, the upper surface of the exhaust-intake piston, the cylinder inner surface, and the lower surface of the cylinder head define an exhaust chamber 132. When the exhaust-intake piston is at its closest approach to the cylinder head, the combustion/exhaust chamber is at a minimum volume hereinafter designated as the clearance volume Vc.

While the inlet ports of a particular cylinder are open, the lower surface of the corresponding exhaust-intake piston, the cylinder inner surface, and the upper surface of the corresponding expansion-compression piston define an intake chamber 134. When the inlet ports are closed and the exhaust passage is vented, the intake chamber becomes a pre-mix chamber 135.

Referring to FIGS. 1-3 and 10-20, the bypass channels formed in the cylinder wall, near the second end surface, can be hemi-spherical, semi-ovoid, rectangular, or any other shape optimal for creating desired flow conditions in the clearance volume during the compression stroke. The bypass channels have volumetric centers defining a passage plane 136. In the embodiment shown in FIGS. 1 and 11, the bypass channels are hemi-spherical and the passage plane is in registration with TDC, so that each of the bypass channels extends equally below and above TDC. Alternatively, the passage plane can be offset from TDC along the cylinder axis, away from the cylinder head (FIG. 2) or toward the cylinder head (FIG. 3); and/or the passage plane can be angled relative to the plane TDC, or helical about the cylinder axis, according to the desired flow conditions in the combustion chamber during the compression stroke. Preferably, the bypass channels are configured so as to provide a very good swirl (rotational motion) and squish (radial inward motion) for the air-fuel mixture inside the combustion chamber.

In the embodiment shown in FIGS. 10-20, the inlet ports formed in the intake manifold inner wall are rectangular. However, the inlet ports can be of various shapes optimal for creating desired flow conditions in the intake chamber during the exhaust-intake stroke. In particular, the inlet ports can be shaped according to the designed motions of the slide valve, the exhaust-intake piston, and the expansion-compression piston so as to provide optimal flow of an air-fuel mixture into the intake chamber during the exhaust-intake stroke. For example, the inlet ports can be shaped so as to provide turbulent mixing flow in the intake chamber throughout the exhaust-intake stroke.

Figure 10:
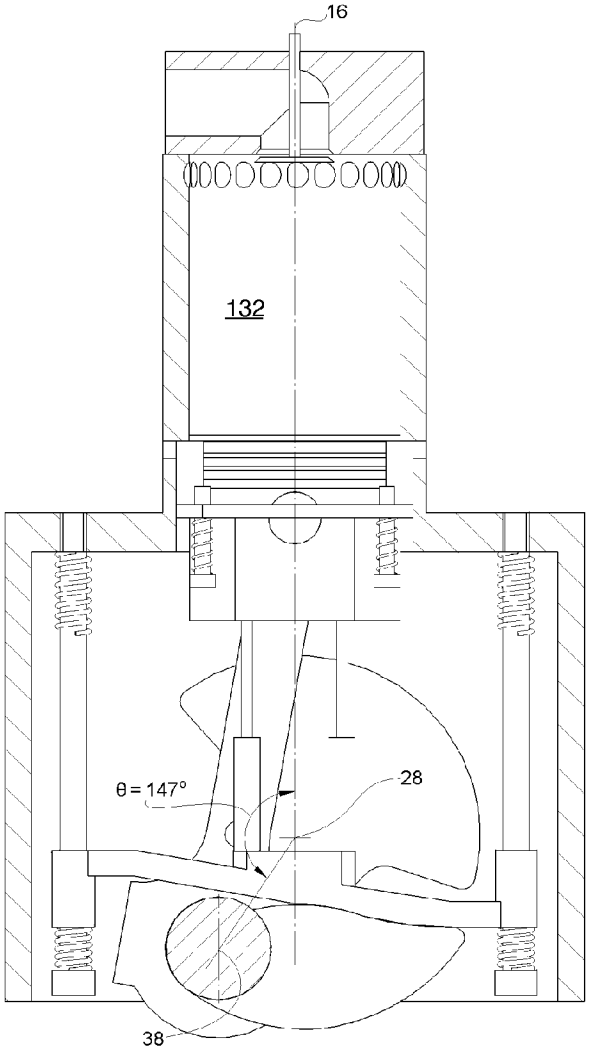
FIG. 10 is a section view of the engine of FIG. 8, at a crankshaft rotation angle θ=147°.

Referring to FIGS. 6, 7, and 10, the cam follower base includes first and second end members 138 and two substantially identical side members 140 having curvilinear profiles. Each end member of the cam follower base defines a midplane 142, and the midplane of the first end member is offset from the midplane of the second end member according to the curved profiles of the side members. The end members and the side members are arranged to define a substantially rectangular frame having four corners, the frame surrounding a substantially rectangular opening 144. The end members and the side members are dimensioned such that, when the cam follower base is assembled in the engine as shown in FIG. 8, the connecting rod can oscillate within the rectangular opening through a full rotation of the crankshaft to accomplish a full stroke of the expansion-compression piston.

Referring to FIG. 6, each side member of the cam follower base has a lower cam following surface 146 for controlling motion of the exhaust-intake piston according to the profile of the cams, and has an upper surface 148 disposed at a substantially uniform offset from the cam following surface, the upper surface also including a upwardly-stepped midsegment 150. Each side member midsegment supports two push rod supports arranged for rigidly receiving the base ends of exhaust-intake piston push rods. Each side member also has an inward surface 152 facing the opposing side member, and has a catch 154 protruding from the inward surface toward the opposing side member. Each side member catch has curved upper and lower surfaces and a flat inward surface. When the cam follower base is assembled in the engine as shown in FIG. 8, the small cylinders of the connecting rod can contact the catch upper surfaces to drive the cam follower base away from the cylinder head, as described in further detail below with reference to FIG. 15.

Each corner of the rectangular frame supports a guide sleeve 156 for slidably receiving one of the guide rods extending downward from the sump upper wall. The guide sleeves at corners of the first end member protrude toward the midplane of the second end member, and the guide sleeves at corners of the second end member protrude toward the midplane of the first end member.

Referring to FIG. 8, the guide rods are formed with shafts for slidable motion within the guide sleeves, and with guide rod heads for supporting the cam follower base. The guide rod shafts are threaded for removable assembly to the block upper wall. Upper cam follower springs are disposed on the guide rods between the guide sleeves and the block upper wall, and lower cam follower springs are disposed on the guide rods between the guide sleeves and guide rod heads. At appropriate crankshaft speeds, the cam follower springs and the exhaust-intake piston assembly form a spring-mass system that oscillates so as to minimize contact forces between the cam follower base and the cams.

Referring to FIGS. 8-14, each slide valve is slidably movable on the valve pins corresponding to one of the cylinder openings. Each slide valve includes two gate segments 164 that are configured to closely fit between the outer circumferential surface of the corresponding expansion-compression piston upper portion and an inner surface 166 of the intake manifold inner wall surrounding the corresponding cylinder opening. Each slide valve also includes a substantially planar flange 168 surrounding a central opening configured to closely fit around the lower axial portion of the expansion-compression piston skirt. The slide valve flange has an upper surface 172 for contacting the shoulders of the expansion-compression piston skirt. The slide valve flange also includes pin holes arranged about the central opening for receiving the valve pins.

Each valve pin is formed with a head for supporting the slide valve flange and with a shaft for sliding motion within the slide valve pin holes. The valve pin shaft is threaded for removable assembly to the block upper wall. A valve spring is disposed on each valve pin between the slide valve flange and the valve pin head. The valve springs bias the slide valve toward an upper position, in which the gate segments abut against the first end surface of the corresponding cylinder wall and sealingly block the corresponding inlet ports.

Figure 16:
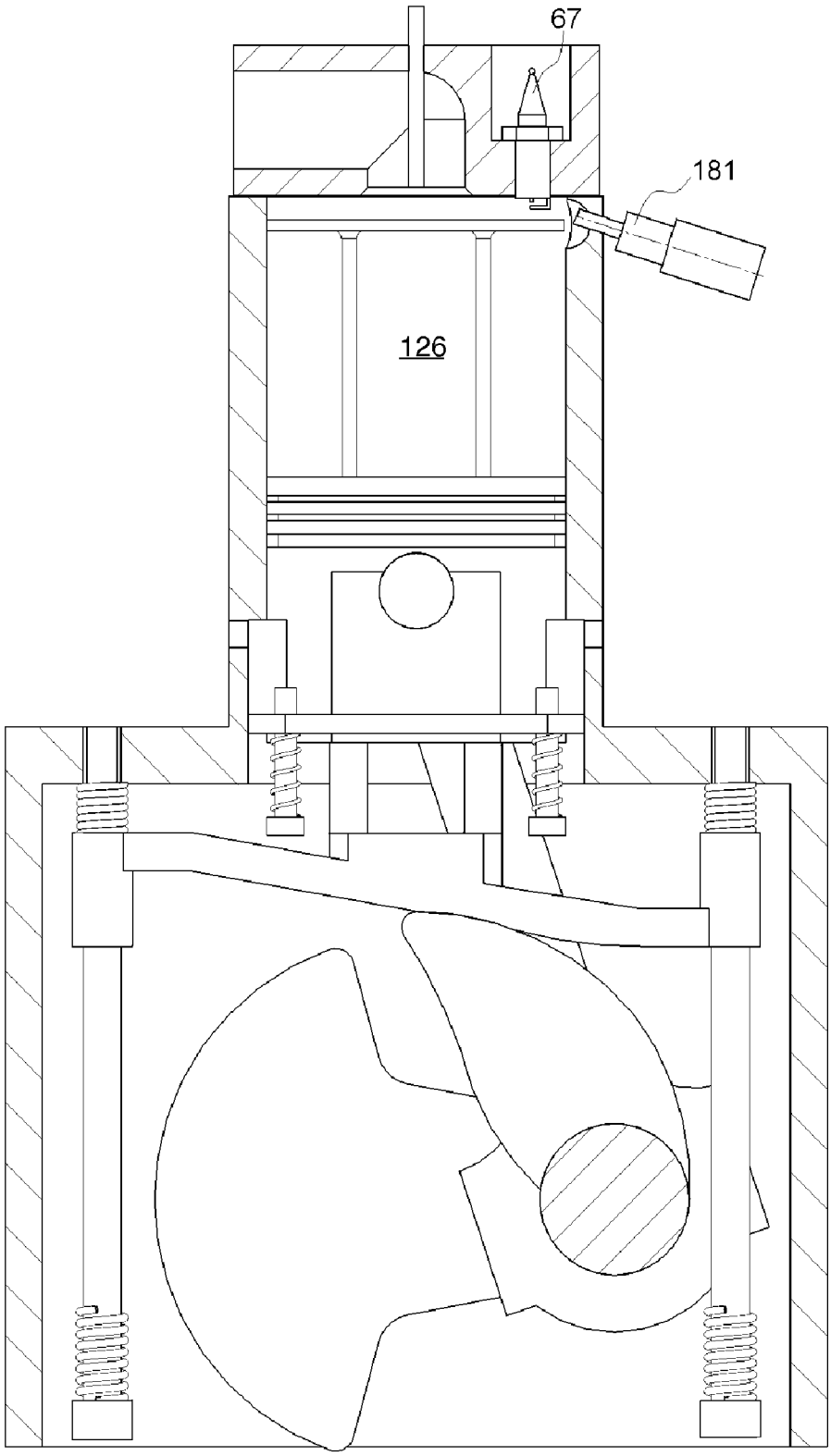
FIG. 16 is a section view of a three stroke engine adapted for direct injection of a fuel-air mixture, according to an embodiment of the present invention.

Referring to FIG. 16, an injector 181 can be mounted in one of the bypass channels.

Referring to FIGS. 17-27, in a second embodiment of the present invention, like parts to the first embodiment are numbered alike.

Figure 17:
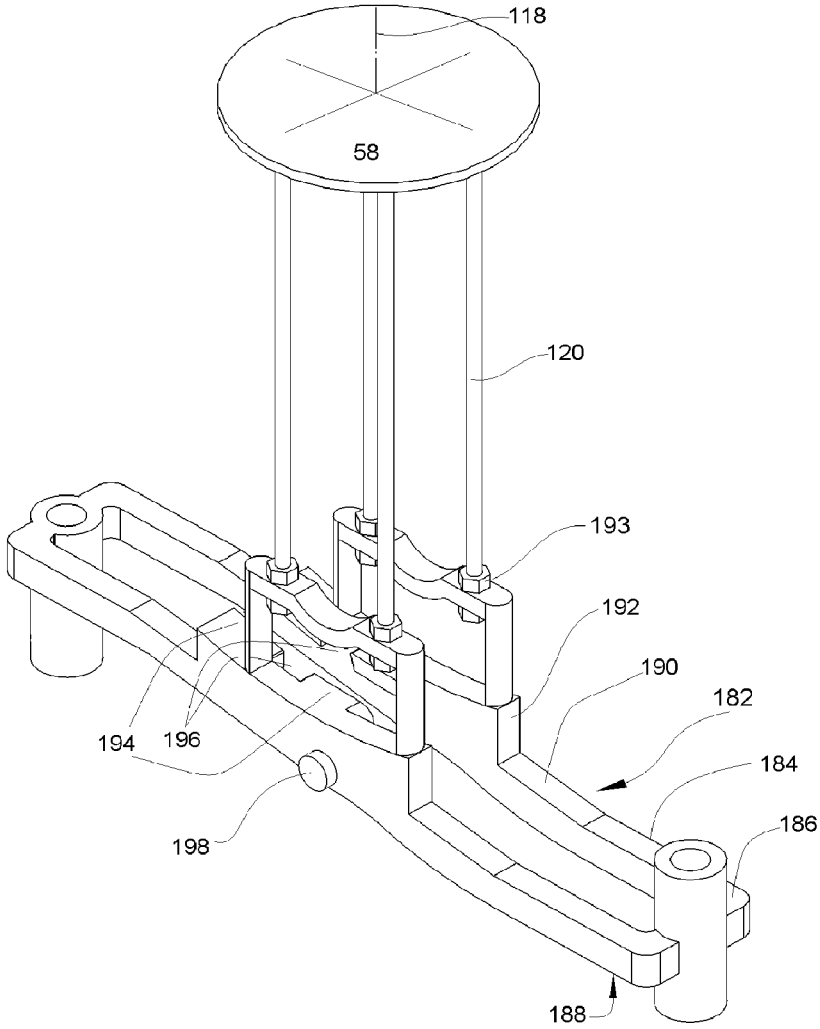
FIG. 17 is a perspective view of an exhaust-intake piston assembly, according to a second embodiment of the present invention.

Referring to FIG. 17, an exhaust-intake piston is rigidly attached by push rods to a modified cam follower base 182. The modified cam follower base includes two side members 184 joined by curved end pieces 186. Each side member has a curved lower cam following surface 188 and a stepped upper surface 190. The lower cam following surface and the stepped upper surface define two end segments and a mid-segment 192 of the side member. A ledge 194 protrudes inward from each side member mid-segment. Each ledge includes two curved portions separated by a gap 196. As better shown in FIG. 21, a guide roller 198 protrudes outward from each side member mid-segment. Referring back to FIG.

18, an arch 202 is mounted to each side member mid-segment. Each arch has two holes for receiving the push rods, which are fastened with nuts 193. A guide rod sleeve is mounted to each curved end piece.

Figure 18:
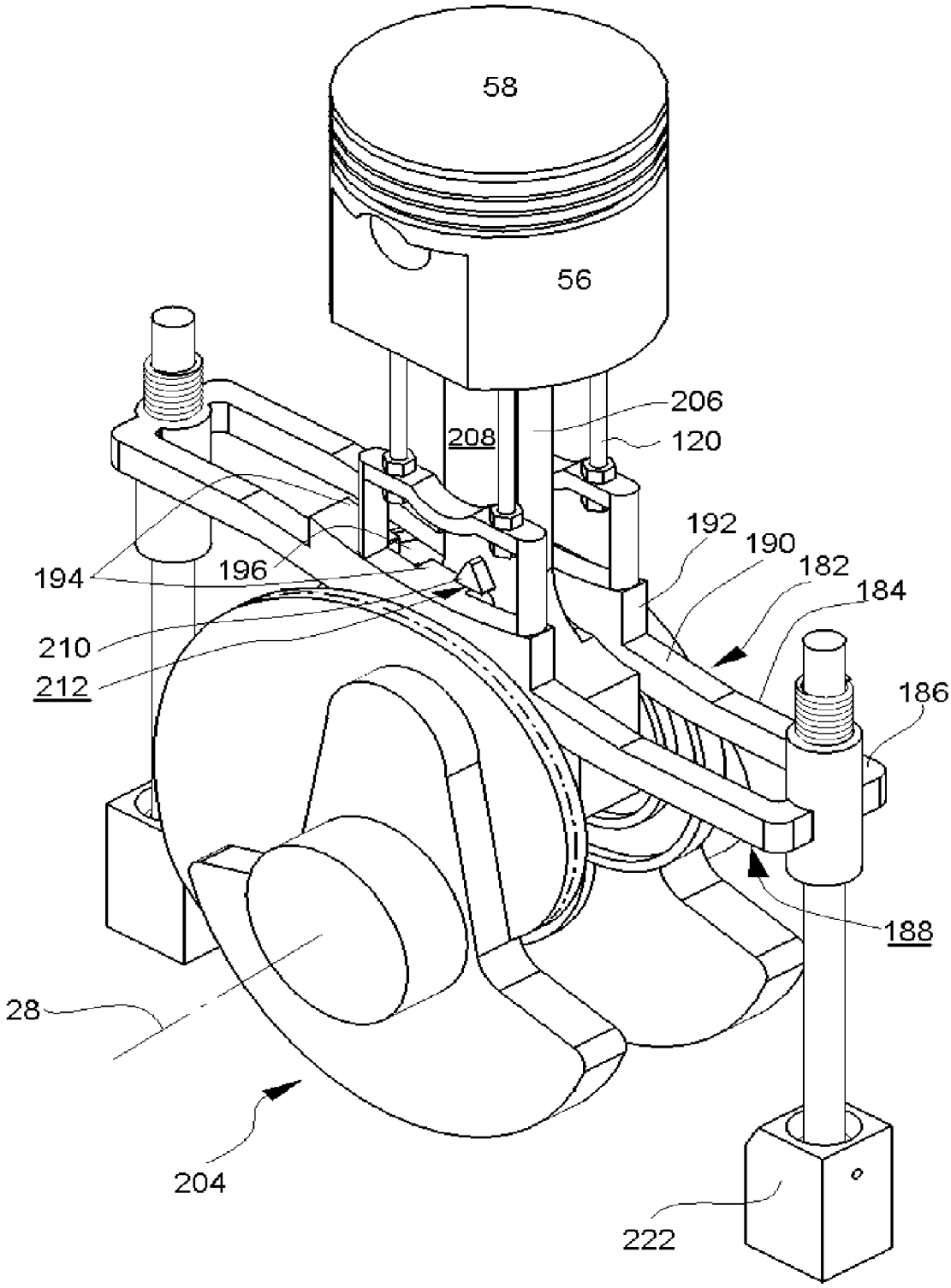
FIG. 18 is a perspective view of an exhaust-intake piston assembly and an expansion-compression piston assembly, according to the embodiment of FIG. 17.

Still referring to FIG. 18, an expansion-compression piston is movably connected to a modified crankshaft 204 by a connecting rod 206. The connecting rod includes an upper end, a lower end, and a web 208 extending therebetween. The connecting rod upper end is coupled to the piston by a wrist pin. The connecting rod lower end is fastened to the crankshaft by a connecting rod clamp. Prisms 210 protrude from opposed side surfaces of the web. Each prism is substantially triangular in cross-section, having a lower surface 212 curved at a radius of one hundred thirty (130) mm. Referring to FIG. 18, when the connecting rod is assembled within the modified cam follower base, each connecting rod prism is dimensioned so as to fit through the gap of the corresponding ledge.

Figure 19:
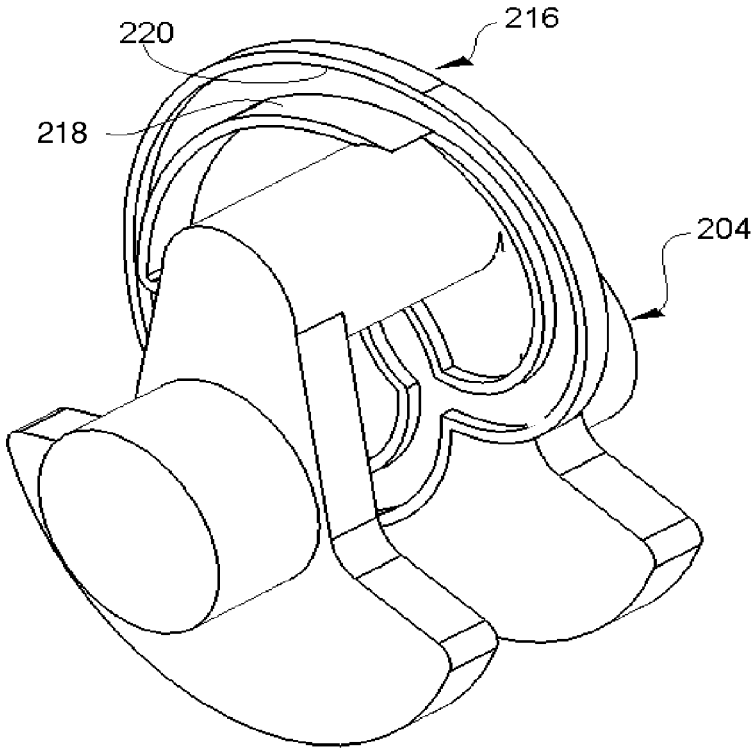
FIG. 19 is a perspective view of a crankshaft including combined cam and cardioid path guide surfaces, according to the embodiment of FIG. 17.

Referring to FIG. 19, the modified crankshaft includes guide plates 216. Each guide plate includes an external cam surface 218 similar to the cams of the first embodiment, and also includes an internal cardioid path 220.

Referring to FIGS. 20-27, the external cam surface contacts the lower surface of the corresponding modified cam follower base. The internal cardioid path captures the guide roller of the corresponding modified cam follower base. Note that the guide rod lower ends can be mounted in dashpots 222 at the bottom of the sump. As discussed in further detail below, the dashpots advantageously permit hydraulic braking of the modified cam follower base by the guide rod sleeves.

The three stroke internal combustion engine can be fabricated from various materials according to known methods and processes such as casting, stamping, forging, or injection molding. By using an internal combustion cycle, the engine components are subjected to a relatively low average operating temperature as compared to the operating temperatures of components in steam or gas turbine engines. The block, cylinders, cylinder heads, and expansion-compression pistons can be fabricated from sturdy and durable materials, including metals, ceramics, polymers, or composites, by various known methods. For example, molded aluminum blocks and cylinders can be used with cast iron cylinder liners. The exhaust-intake piston, which is repeatedly exposed to combustion temperatures and lacks external cooling, is optimally formed from a material with superior high-temperature toughness. The crankshaft, connecting rods, cam follower bases, push rods, slide valves, guide rods, valve pins, springs, and other components can likewise be fabricated from a variety of durable and sturdy materials by known methods. The present invention is not limited to any particular mode or method of making the component parts, and no particular mode of manufacture is known to be preferred.

In operation, referring to FIGS. 1-4, the engine of the present invention works in a three-stroke cycle: expansion stroke, exhaust-intake stroke, and compression stroke. The three strokes are accomplished within a single revolution of the crankshaft, in which each of the two pistons reciprocates once. The expansion-compression piston and the exhaust-intake piston are in contact and move together for the majority of the expansion stroke, but move separately during the exhaust-intake stroke and the compression stroke.

The working of the engine will now be explained for the first cylinder of the first embodiment through a complete revolution of the crankshaft, for various values of a crankshaft angle, θ, measured in a counterclockwise direction from the first cylinder axis to the first cranking axis in the cylinder center plane, as shown in FIG. 9.

Referring to FIGS. 1*a*-3*a*, and 8-9, both pistons begin the expansion stroke in the vicinity of the TDC plane, θ=0°. Referring to FIG. 8, the block, the head, and the first cylinder are sectioned at the midplane of the first cylinder. The crankshaft is sectioned outside the circumference of the first cylinder to provide a good view of the counterweight and cam. The compression/combustion chamber is full with a compressed air-fuel mixture that has just been ignited and is becoming a super-compressed mixture of burned gases. This view represents the beginning of the expansion stroke.

Referring to FIG. 9, at the beginning of the expansion stroke, the lower surface of the exhaust-intake piston contacts the upper surface of the expansion-compression piston body, so that the TDC plane lies between the expansion-compression and exhaust-intake pistons. The air-fuel mixture is ignited either by spark or by adiabatic auto-ignition. After ignition, expanding combustion gases force both pistons toward the BDC plane. The dashed line in FIG. 9 shows the catches formed on the exhaust-intake piston cam follower base. The catches work together with the small cylinders on the connecting rod to ensure that the exhaust-intake piston goes from its highest point, something like 3 mm above the TDC plane, to the TDC plane during the interval $\theta=340° \leqq \theta=360°$. This arrangement also ensures that this piston reciprocates together with the expansion-compression piston for the interval $\theta=0° \leqq \theta=20°$. The upper cam follower springs also force the pistons in the same direction.

At θ=120° (not shown), the lower cam follower springs start to absorb the downward kinetic energy of the exhaust-intake piston assembly. At θ=140° (not shown), the exhaust valve mounted in the head of the engine starts to open.

At θ=147°, as shown in FIGS. 1*b*-3*b* and 10, the expansion stroke ends and the exhaust-intake stroke starts. For θ=147°, the expansion-compression displacement s(θ)=s(147°)=10 cm, the expansion ratio ($r_e$) is 12.1 (clearance volume ($V_c$) =45 $cm^3$:expansion volume ($V_e$)=500 $cm^3$; $r_e=(V_c+V_e)/V_c$). With this expansion ratio, the cylinder pressure should be, at this point, approximately the atmospheric pressure. At this angle, referring to FIG. 10, three things happen: a) the shoulders of the descending expansion-compression piston contact the upper surface of the slide valve flange; b) the exhaust-intake piston stops moving downward and starts to move toward the cylinder head, driven by the contact of the cams and the lower cam follower springs against the lower surface of the cam follower base; c) the exhaust valve starts to open.

Preferably, most of the necessary force to drive the exhaust-intake assembly is initially provided by the lower cam follower springs. The slide valve starts to open the inlet port by the descending movement of the expansion-compression piston. As the exhaust-intake piston moves toward the cylinder head, the burned mixture of combustion gases is expelled from the exhaust chamber through the partly-open exhaust valve (the exhaust stroke). Meanwhile, motion of the exhaust-intake piston away from the expansion-compression piston aspirates the air-fuel mixture through the inlet ports to the intake chamber (the intake stroke).

For an application where the TSE is to be run continuously at substantially constant RPMs, the lower cam follower springs can be tuned to exactly absorb the downward energy of the cam follower base. For example, the TSE can be optimized for use as a generator engine in hybrid vehicles.

Referring to FIGS. 1*c*-3*c*, the cams continue to engage the cam following surface of the cam follower base, so that the exhaust-intake piston rapidly moves toward the Top Dead Center plane TDC. Meanwhile, rotation of the crankshaft continues to pull the connecting rod and the expansion-compression piston downward. As the expansion-compression piston upper surface approaches the BDC plane, the expansion-compression piston shoulders contact the slide valve flange and force the slide valve toward a lower position, in which the gate segments do not block the inlet ports.

The motion of the exhaust-intake piston away from the expansion-compression piston body results in aspiration of air-fuel mixture from the inlet ports to the expanding intake volume defined between the expansion-compression piston body and the exhaust-intake piston. Simultaneously, the exhaust valve is opened so that motion of the exhaust-intake piston toward the cylinder head can expel the burned mixture of combustion gases through the exhaust passage.

Figure 12:
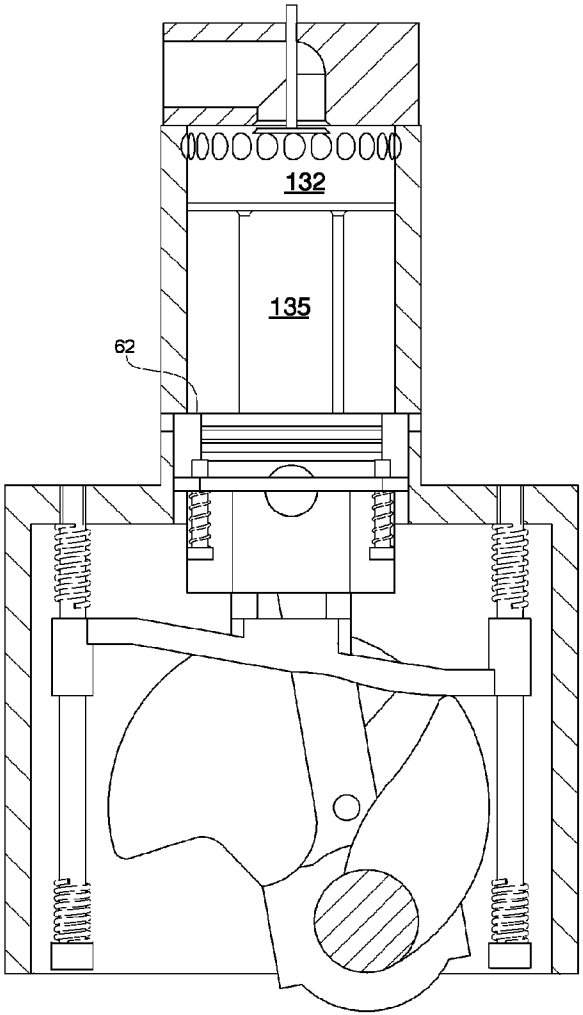
FIG. 12 is a section view of the engine of FIG. 8, at a crankshaft rotation angle θ=213°.
Figure 11:
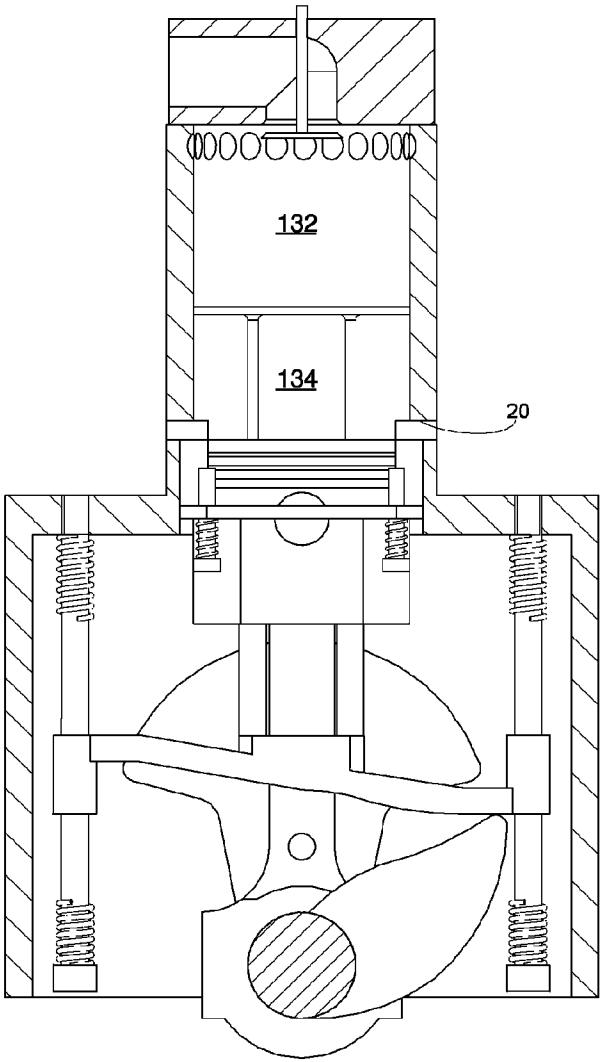
FIG. 11 is a section view of the engine of FIG. 8, at a crankshaft rotation angle θ=180°.

After reaching the BDC plane, the expansion-compression piston is forced upward by the continued rotation of the crankshaft. Upward motion of the expansion-compression piston body releases the slide valve flange, permitting the valve springs to drive the slide valve upward to seal the inlet ports, ending the intake stroke, as shown in FIGS. 1*d*-3*d*. The exhaust-intake piston and the expansion-compression piston body now are moving toward the cylinder head. However, the expansion-compression piston body can move more quickly or less quickly than the exhaust-intake piston. In the case where the expansion-compression piston body moves more quickly, some quantity of the air-fuel mixture is forced from the intake chamber around the exhaust-intake piston and into the combustion chamber, pushing burned gases toward the exhaust valve. As long as the exhaust valve remains open, the exhaust stroke continues. If the engine is configured to run in an overexpanded cycle, then there will be still some burned gas in the combustion chamber when the exhaust valve shuts.

θ=180° (FIG. 11). The slide valve and the exhaust valve are fully opened. The expansion-compression piston is at BDC and the exhaust-intake piston has completed half of the intake stroke. The slide valve and the exhaust valve start to close.

θ=213° (FIG. 12). The upward movement of the expansion-compression piston permits the valve springs to close the slide valve, sealing the inlet ports. The intake stroke is complete.

The exhaust valve continues to close. However, some burned gases remain in the combustion chamber. The expansion-compression piston now moves toward the cylinder head, catching up to the exhaust-intake piston. The upper cam follower springs start to absorb the upward kinetic energy of the cam follower base. Although the intake stroke now has finished, the exhaust-intake piston continues to expel burned gases from the combustion chamber through the exhaust valve. Meanwhile, upward motion of the expansion-compression piston causes further mixing of the air and fuel within the pre-mix chamber. Depending on relative speeds of the exhaust-intake piston and the expansion-compression piston body, and on the position of the exhaust valve, some of the burned gases may be sucked into the intake chamber for mixing with the air-fuel mixture; or some of the air-fuel mixture may be pushed into the combustion chamber, aiding the expulsion of the burned gases.

Figure 29:
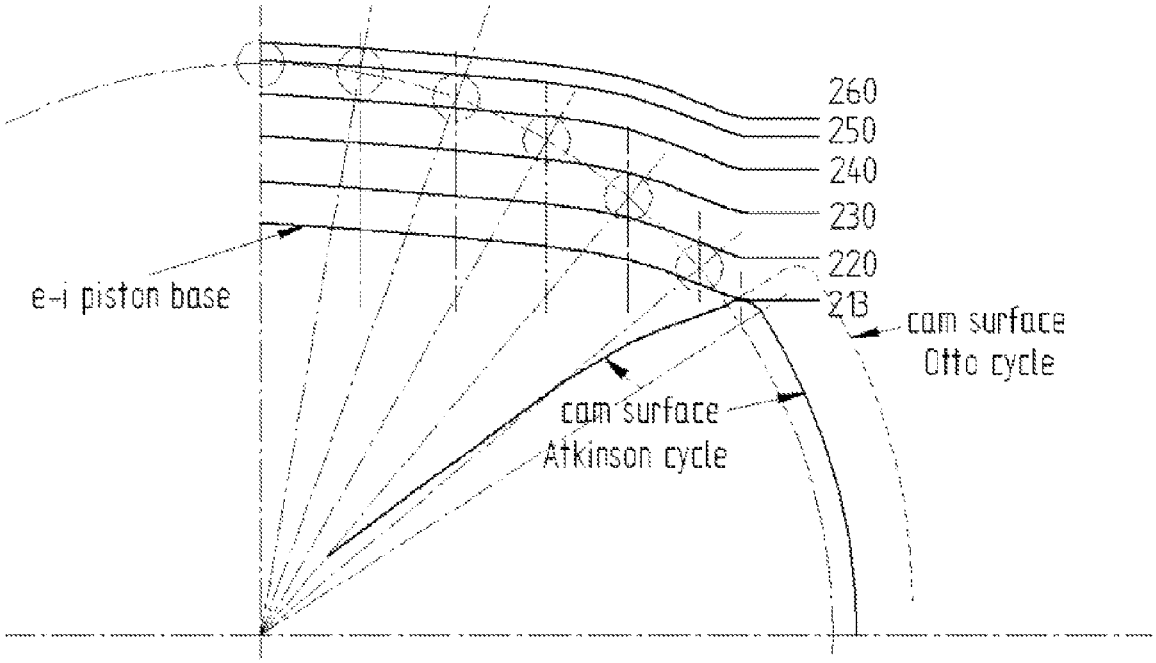
FIG. 29 is a schematic of cam surfaces for obtaining Atkinson and Otto combustion cycles in a three stroke engine, according to various embodiments of the present invention.

Preferably, the engine operates in an Atkinson-type overexpanded cycle, where the intake stroke is finished before the exhaust stroke. In one Atkinson cycle embodiment of the present invention, at θ=213°, the volume trapped in the intake volume ($V_i$), is $pi*(4^2-(4*0.2^2))*8 \cong 400\ cm^3$, which will give a compression ratio, $r_c=(V_c+V_i)/V_c$), of 10.0 (the factor 4*0.2 accounts for the volume occupied by the four push rods with a diameter of 4 mm each). A normal Otto cycle can be obtained by modifying the cams or the cam follower surface in such a way that, at this angle, the exhaust-intake piston would be at its highest point (above the TDC plane). FIG. 29 shows cam surface curves for the Otto cycle and for the Atkinson cycle.

Preferably, the lower cam following surfaces are manufactured as shown in FIG. 29 so that the exhaust-intake piston and the expansion-compression piston move at substantially the same speed during the exhaust stroke (θ=about 213° to about 260°). In the most preferred embodiment, the volume between the exhaust-intake piston and the expansion-compression piston will expand from θ=213° to θ=230° by about eight percent (8%), then will contract from θ=230° to θ=260° back to about three percent (3%) larger than the volume at θ=213°.

Figure 14:
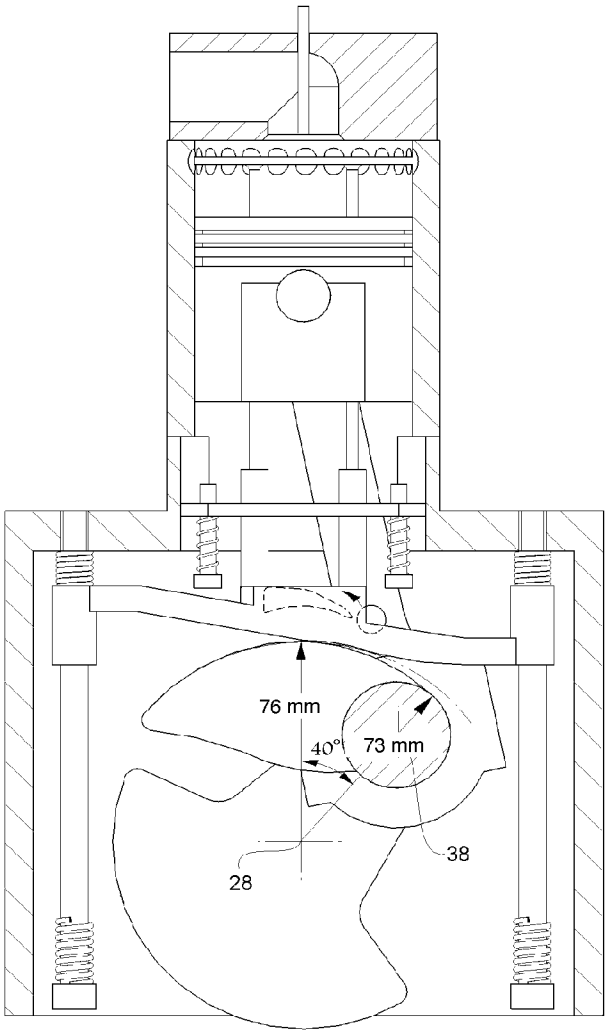
FIG. 14 is a section view of the engine of FIG. 8, at a crankshaft rotation angle θ=320°.
Figure 13:
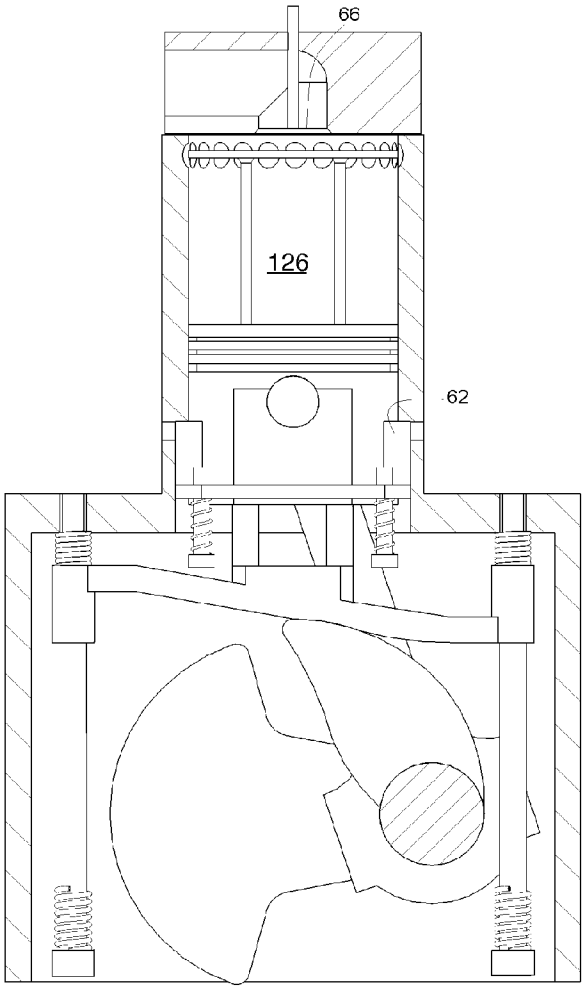
FIG. 13 is a section view of the engine of FIG. 8, at a crankshaft rotation angle θ=270°.
Figure 15:
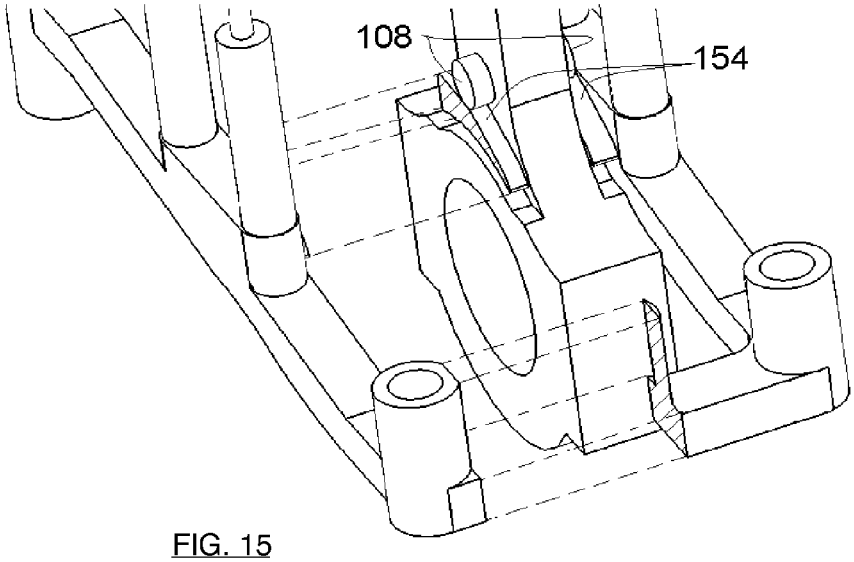
FIG. 15 is a section view of the engine of FIG. 14, showing a connecting rod cylinder engaging a catch surface of a cam follower base, according to an embodiment of the present invention.

After the combustion chamber has been reduced to the clearance volume, so that nearly all the burned gas is expelled from the engine, the exhaust valve closes and the compression stroke begins, as shown in FIGS. 1*e*-3*e*. During the compression stroke, the exhaust-intake piston remains essentially stationary near the TDC plane while the expansion-compression piston body moves toward the TDC plane, collapsing the compression chamber and forcing the air-fuel mixture past the exhaust-intake piston into the clearance volume. Some leakage of fuel-air mixture from the intake chamber to the sump may occur along the exhaust-intake piston push rods. To minimize such leakage, the push rods are dimensioned so as to form an oil seal with the holes of the expansion-compression piston. Various solutions to the possibility of leakage would be known as acceptable by one of ordinary skill in the art.

θ=250° (not shown). The exhaust-intake piston has completed at this angle the exhaustion of the burned gases. The exhaust valve is now closed. The exhaust-intake piston is at its closest approach to the cylinder head, 3 mm beyond the TDC plane and exactly on the center of the bypass channels.

θ=270° (FIG. 13). The expansion-compression piston has accomplished approximately 35% of the compression stroke. The cams are configured such that the exhaust-intake piston remains at its highest point, something like 3 mm above the TDE and exactly on the center of the bypass channels.

θ=320° (FIG. 14). In a preferred embodiment, the cams are formed in such a way that, at this angle, the exhaust-intake piston starts to move toward the expansion-compression piston upper surface until the exhaust-intake piston reaches the position shown in FIG. 14. During the last 40 degrees of crankshaft rotation, the radial distance from the cam surfaces to the crankshaft axis diminishes from 76 mm to 73 mm. Accordingly, the cam follower springs and the small cylinders of the connecting rod, in cooperation with the cam follower catches, can force the exhaust-intake piston towards the TDC plane. This movement is important because, between θ=330° to θ=350°, the air-fuel mixture is ignited by the igniter housed in the cylinder head, and the pressure in the combustion chamber starts to rapidly increase. Prior downward movement of the exhaust-intake piston alleviates compressive forces acting on the push rods.

θ=360° (FIGS. 12 and 13). The three-stroke combustion cycle is completed.

Figure 1:
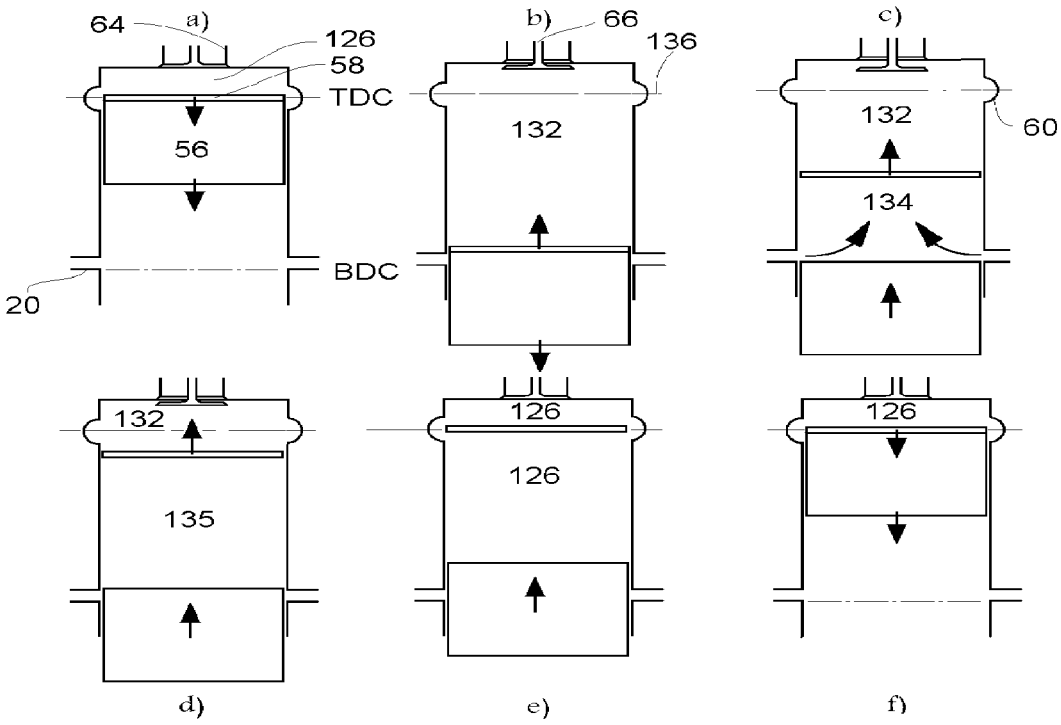
FIGS. 1-3 are schematic illustrations of a three-stroke combustion cycle showing different arrangements of bypass channels in an engine according to various embodiments of the present invention.
Figure 2:
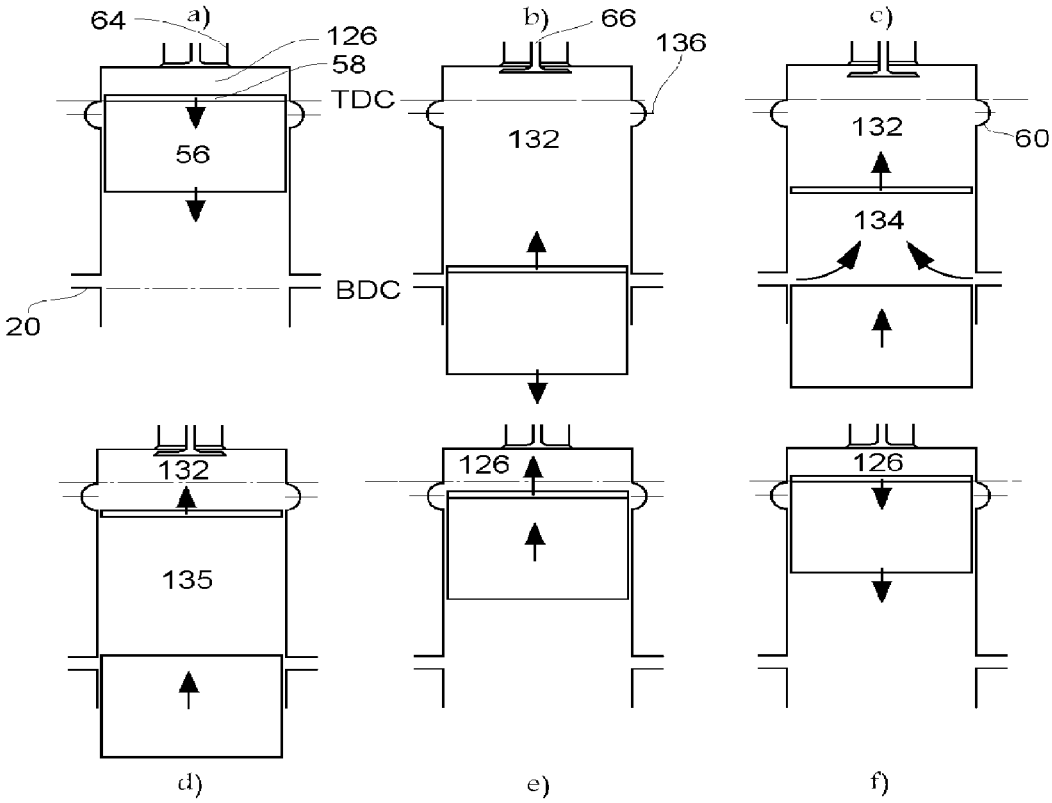
Figure 3:
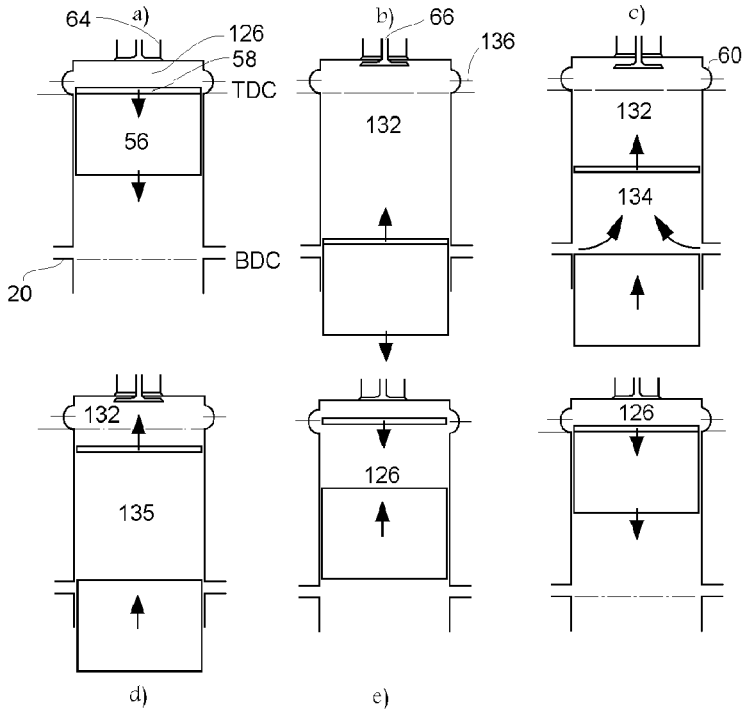

There are two basic ways of getting the air-fuel mixture from the intake volume to the clearance volume. One way is through bypass channels formed in the cylinder wall, as shown in FIGS. 1, 2 and 3. The bypass channels can be hemi-spherical, semi-ovoid, rectangular, or any other shape optimal for creating desired flow conditions in the clearance volume during the compression stroke. In the preferred embodiment, the bypass channels are hemi-spherical as shown in FIGS. 1, 2, and 3. The bypass channels can have three possible arrangements.

When the center of the bypass channels is positioned at the TDC plane, then after the exhaust-intake stroke is finished, the exhaust-intake piston will remain stopped until the expansion-compression piston also has reached the TDC plane. However, most spark-ignition engines are ignited before the combustion chamber reaches minimum volume. If the engine of the present invention is ignited before the expansion-compression piston reaches the TDC plane, but while the cam follower base still supports the exhaust-intake piston above the TDC plane, then expanding combustion gases will push downward on the upper surface of the exhaust-intake piston, which, in turn, puts undesirable compressive force on the exhaust-intake piston push rods. The exhaust-intake piston assembly is designed to be lightweight so as to minimize pumping losses during exhaust and intake. Thus, the expansion-compression piston and the connecting rod should preferably support the exhaust-intake piston during the expansion stroke. Arranging the bypass channels at the TDC plane is expected to limit the engine to running at low rpm when ignition is expected to occur practically simultaneously with arrival of the expansion-compression piston upper surface at the TDC plane.

When the passage plane is below the TDC plane, the exhaust-intake piston decreases its speed toward the cylinder head as the exhaust-intake piston passes the centers of the bypass channels (FIG. 2*d*), such that all air-fuel mixture passes from the intake volume to the clearance volume before ignition; that is, the upper surface of the expansion-compression piston body contacts the lower surface of the exhaust-intake piston before reaching the TDC plane. After that, the pistons move together towards the TDC plane (FIG. 2*e*). Alternatively, when the center of the bypass channels is put above the TDC plane, the cams are configured to force the exhaust-intake piston lower surface to a position a little bit above the TDC plane. Accordingly, before the ignition occurs, the exhaust-intake piston moves away from the cylinder head, toward the TDC plane (FIG. 3*e*). This movement is expected to alleviate undesirable forces on the exhaust-intake piston push rods.

The other way of passing the air-fuel mixture from the intake volume to the clearance volume is through bypass check valves that are mounted in the exhaust-intake piston, as shown in FIG. 4. In this configuration it is desirable that the exhaust-intake piston be supported by the expansion-compression piston upper surface, or that the cams disengage from the cam follower base, before ignition of the air-fuel mixture in the combustion chamber.

Referring back to FIG. 16, in any of the variations of the present invention, the injector can be provided in one of the bypass channels so as to provide direct injection of a rich fuel-air mixture to the combustion chamber via the bypass channel. Direct injection of the rich mix can be timed to occur just before, at, or soon after TDC depending on the desired engine performance. Providing just one bypass channel, in which the injector is housed, is expected to enhance homogeneous mixing of the rich fuel-air mixture with the lean mix from the intake chamber.

A rich fuel-air mixture can be directly injected at the end of compression stroke (gasoline/Otto engines); or at the end of compression stroke and beginning of the expansion stroke (Diesel engines).

Alternatively, an ultra lean burn/stratified-charge approach can be used, wherein a lean mix is obtained by injecting a small amount of fuel during the intake stroke through secondary injectors in the manifold. This lean mix is sucked into the intake chamber as in other embodiments of the present invention, but could be significantly leaner than the mix typically used for indirect injection according to the present invention. At the end of the compression stroke a richer fuel-air mixture is directly injected via the injector in the bypass channel.

Another ultra lean burn/stratified-charge approach uses the injector to inject a small amount of fuel to the combustion chamber during the intake stroke. At the end of the compression stroke, the same nozzle injects a richer mixture around the spark plug. In this case the fuel-air mixture at ignition is more stratified than in the above approach.

The preferred approach for direct injection is to inject small pulses of fuel to the combustion chamber throughout the compression stroke to obtain a lean mixture. Timing the fuel pulses according to relative motion of the pistons can optimize the mixing of fuel and air in the combustion chamber.

Referring to FIGS. 17-28, the second embodiment of the present invention operates similarly to the first embodiment described above, and accomplishes a complete internal combustion cycle through a single crankshaft rotation ($\theta$=0°-360°). However, the internal cardioid paths, the guide rollers, the ledges, and the connecting rod prisms interact to provide additional control of the exhaust-intake piston movement relative to the expansion-compression piston.

Figure 20:
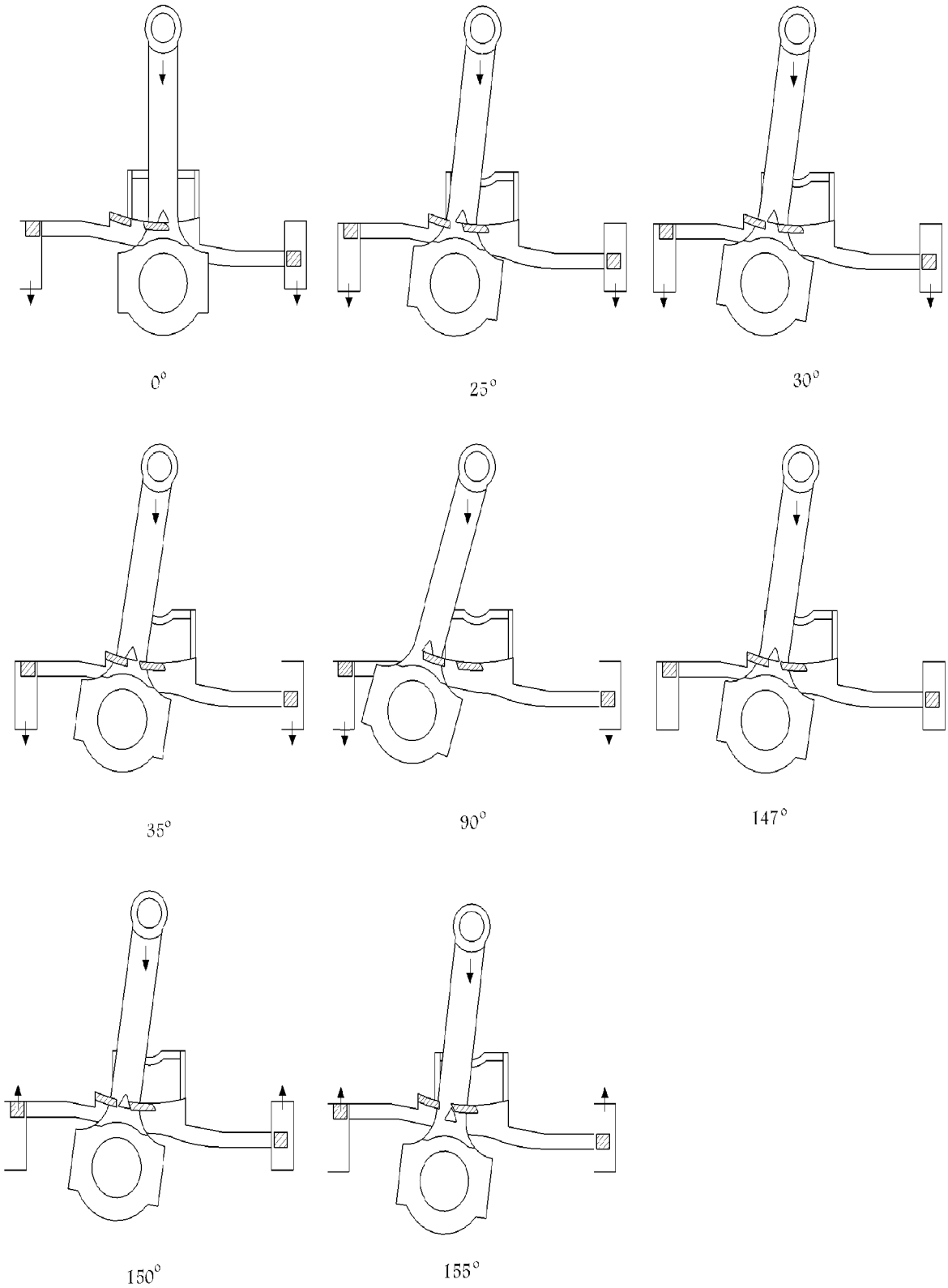
FIG. 20 is a sequence of partial schematic views of the assembly of FIG. 18 in operation.
Figure 21:
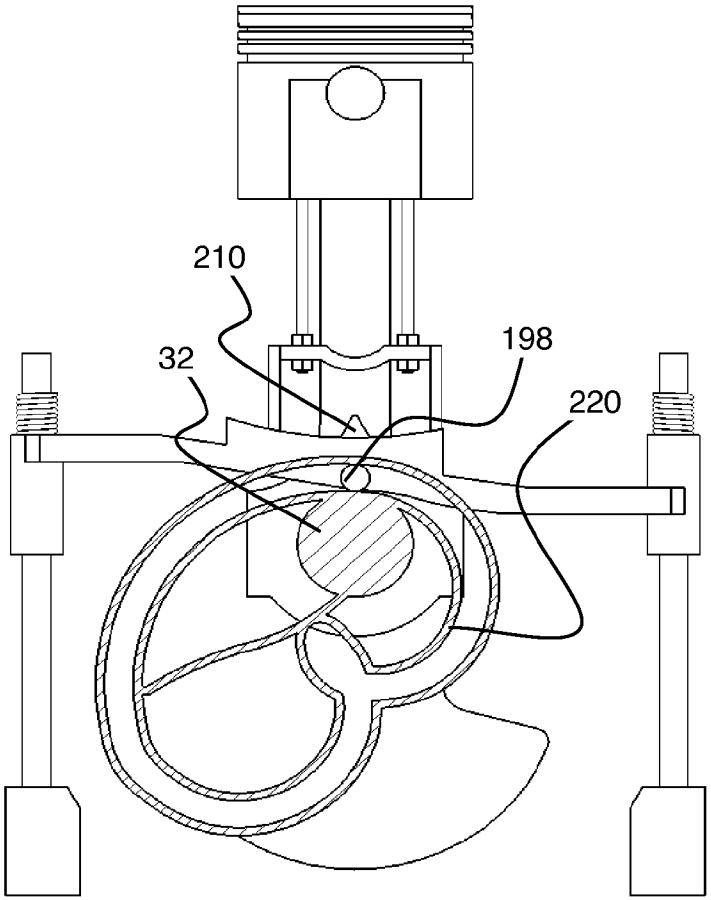
FIG. 21 is a section view of an assembly comprising the components shown in FIGS. 17-19.

Referring to FIGS. 20 and 21, both pistons begin the expansion stroke in the vicinity of the TDC plane, $\theta$=0°. The lower curved surface of each connecting rod prism rests atop an upper curved surface of the corresponding ledge on the modified cam follower base. Each guide roller of the modified cam follower base is engaged by the internal cardioid path of the corresponding modified cam surface.

Figure 22:
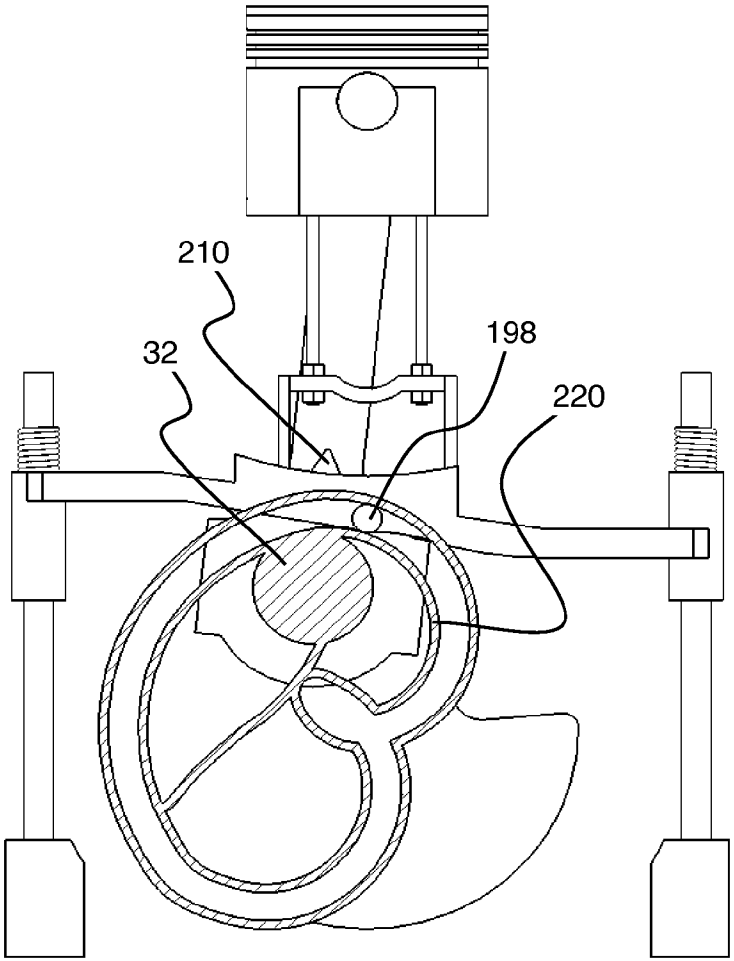
FIG. 22-27 are sequential section views of the operation of the assembly of FIG. 21.

$\theta$=0°-30° (FIGS. 21 and 22). Four forces cause the exhaust-intake piston to reciprocate together with the expansion-compression piston. 1) The pressure inside the combustion chamber. 2) The upper springs. 3) The cardioid paths acting on the corresponding guide rollers of the modified cam follower base. 4) The connecting rod prisms acting on the corresponding ledges of the exhaust-intake piston base.

$\theta$=30°-33° (approximately) (FIG. 22). The connecting rod prisms pass over the gaps in the corresponding ledges. Only three forces act on the exhaust-intake piston forcing it to reciprocate together with the expansion-compression piston. 1) The pressure inside the combustion chamber. 2) The upper springs. 3) The cardioid paths acting on the corresponding guide rollers of the modified cam follower base.

Figure 28:
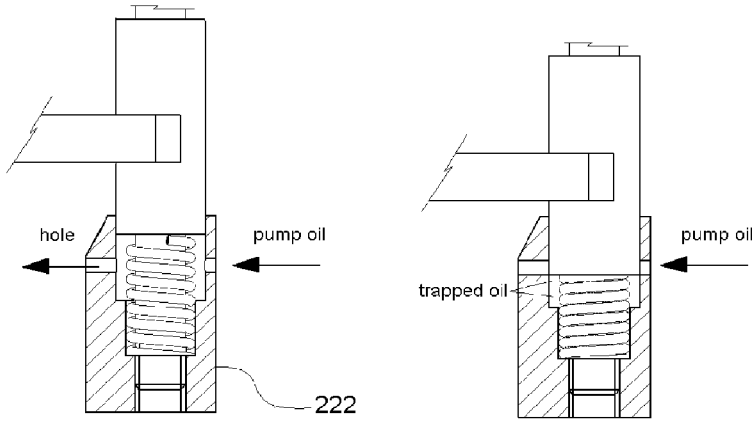
FIG. 28 is a detail section view of a dashpot for limiting motion of the assembly of FIG. 21.
Figure 24:
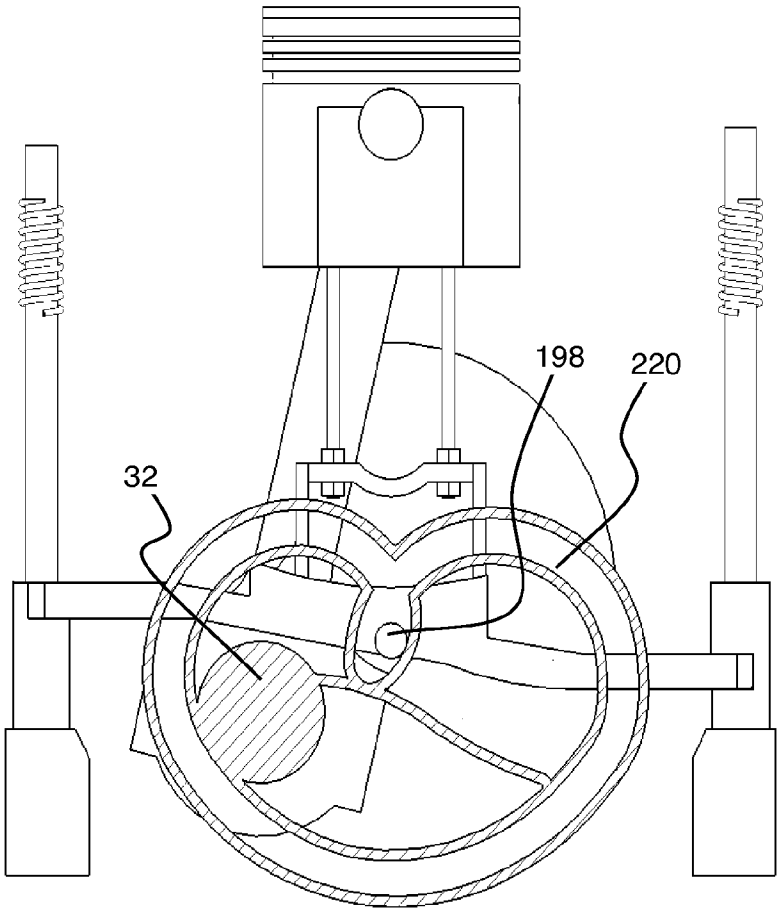
Figure 23:
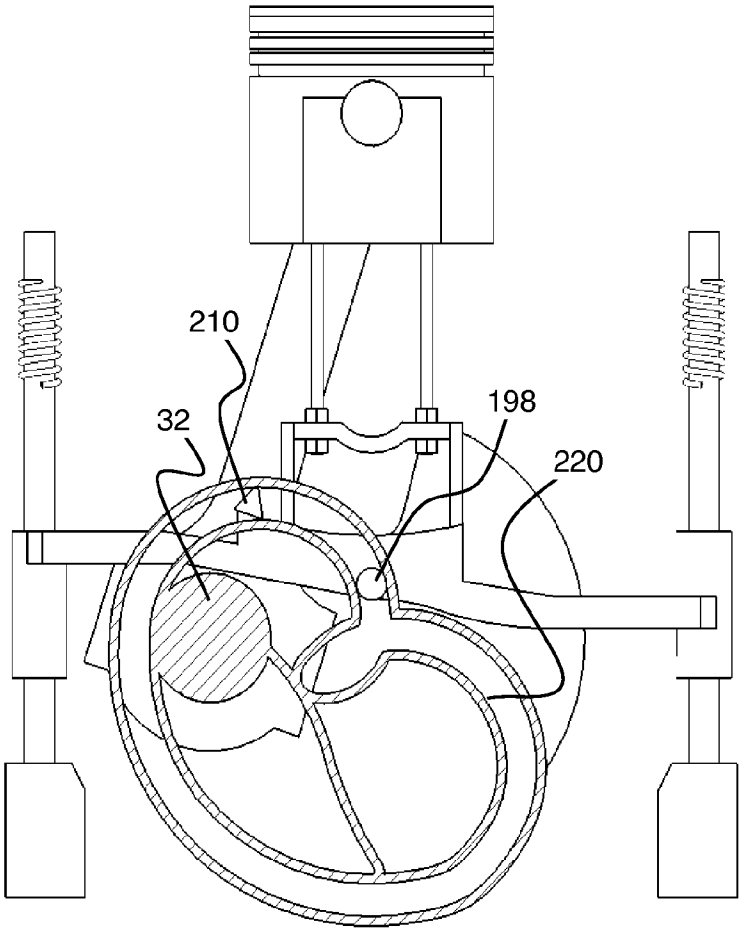
Figure 26:
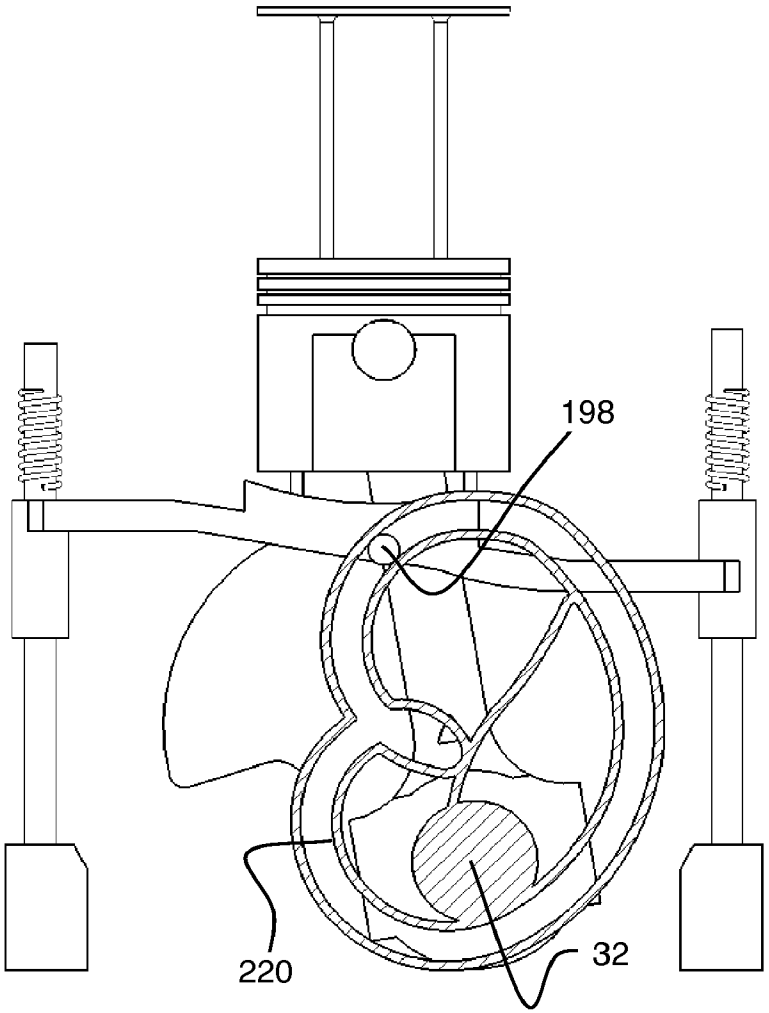
Figure 25:
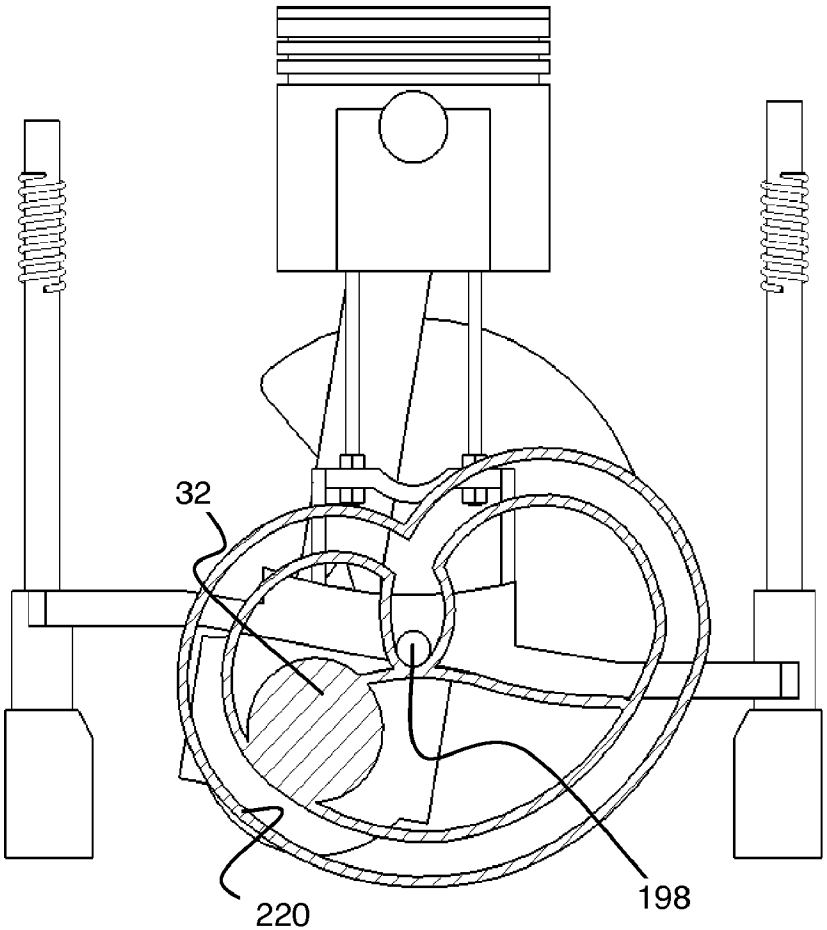

$\theta$=33°-147° (FIGS. 23-25). Through most of the expansion stroke, two forces cause the exhaust-intake piston to reciprocate together with the expansion-compression piston. 1) The pressure inside the combustion chamber. 2) The connecting rod prisms acting on the corresponding ledges. Near $\theta$=147°, lower portions of the guide rod sleeves penetrate into upper openings 226 of the dashpots, forcing oil 228 through narrow ports 230, as shown in FIG. 28. The viscosity of the oil slows the guide rod sleeves, braking the downward motion of the modified cam follower base and of the exhaust-intake piston. Further downward motion of the guide rod sleeves closes the ports, trapping oil in the dashpots to halt the downward motion of the exhaust-intake piston, as shown in FIG. 28.

At $\theta$=147° (FIG. 25), the connecting rod prisms slip through the corresponding gaps, releasing the ledges. From $\theta$=147°-213° (FIGS. 25-26), the external cam surfaces then act on the corresponding lower surfaces of the modified cam follower base to drive the exhaust-intake piston upward and away from the expansion-compression piston, toward the TDC plane.

Figure 27:
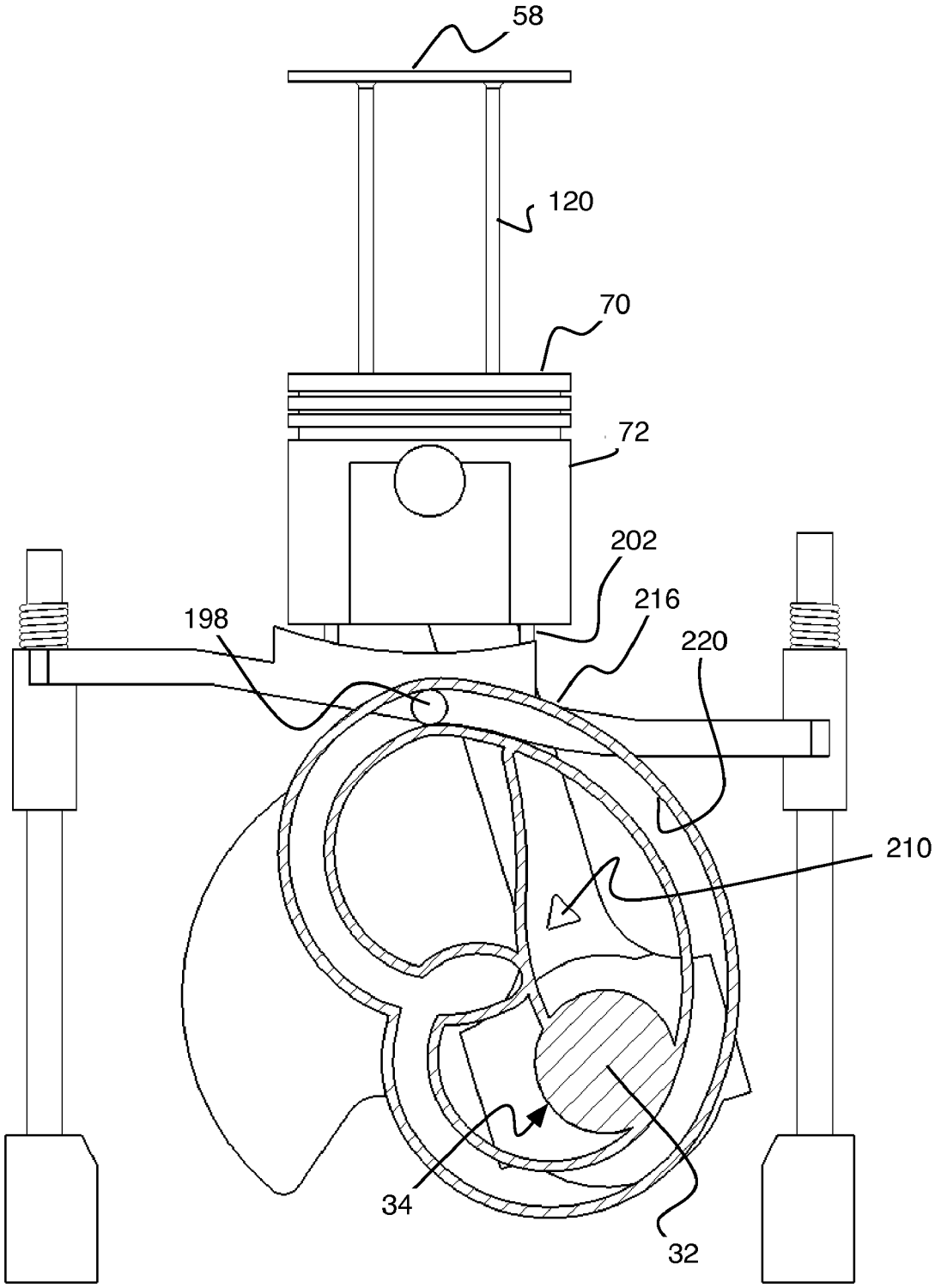

Around $\theta$=213° (FIG. 26), the cardioid paths then re-engage the guide rollers of the modified cam follower base. From $\theta$=213°-250°, the upper cam follower springs and the cardioid path absorb the kinetic energy of the exhaust-intake piston, as shown in FIG. 27 (θ=250°). During this part of the crankshaft rotation, the connecting rod prisms pass around the ends of the corresponding ledges in preparation for the next downward stroke.

From θ=250°-340° (not shown), the cardioid paths engage the guide rollers to maintain the exhaust-intake piston in the vicinity of the TDC plane.

From θ=340°-360° (not shown), the cardioid paths and the upper cam follower springs push the exhaust-intake piston toward its final position slightly above the TDC plane.

One advantage of the present invention is that a complete internal combustion cycle is done with only one revolution of the crankshaft, permitting two cylinders to provide about the same power output as would four cylinders of similar size in a conventional four-stroke engine.

Another advantage of the present invention is that the three-stroke engine naturally operates in an Atkinson or over-expanded cycle, where the expansion rate is bigger than the compression rate, leading to a better efficiency.

A further advantage of the present invention is that, by locating the inlet ports away from the cylinder head, fewer valves are required in the head, making it easier to accommodate a spark plug (for a spark-ignition engine) or central injectors (for a compression-ignition engine).

A further advantage of the present invention is that the exhaust and intake strokes, which do not involve great forces, are accomplished at high speed with a low-inertia piston and push rod assembly; while the compression and expansion strokes, which do involve big forces, are accomplished more slowly by a sturdy piston-connecting rod-crankshaft assembly, which has been shown the best set since 1876. By optimizing the forces and velocities of each stroke in the internal combustion cycle, the present invention is expected to provide significantly better efficiency and power-to-weight ratio than can be obtained from conventional four stroke engines.

A further advantage of the present invention is that the passage of the air-fuel mixture around or through the exhaust-intake piston can enhance homogeneity of the mixture.

A further advantage of the present invention is that the passage of the air-fuel mixture around or through the exhaust-intake piston can pre-heat the mixture by friction.

A further advantage of the present invention is that the passage of the air-fuel mixture around or through the exhaust-intake piston can help to reduce temperature fluctuations in the cylinder walls and head.

A further advantage of the present invention is that the passage of the air-fuel mixture around or through the exhaust-intake piston can result in optimal flow conditions for rapid and complete combustion within the combustion chamber.

A further advantage of the present invention is that direct injection around the spark plug can be easily accomplished.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above-detailed description, but that the invention will include all embodiments falling within the scope of this disclosure.

Figure 30:
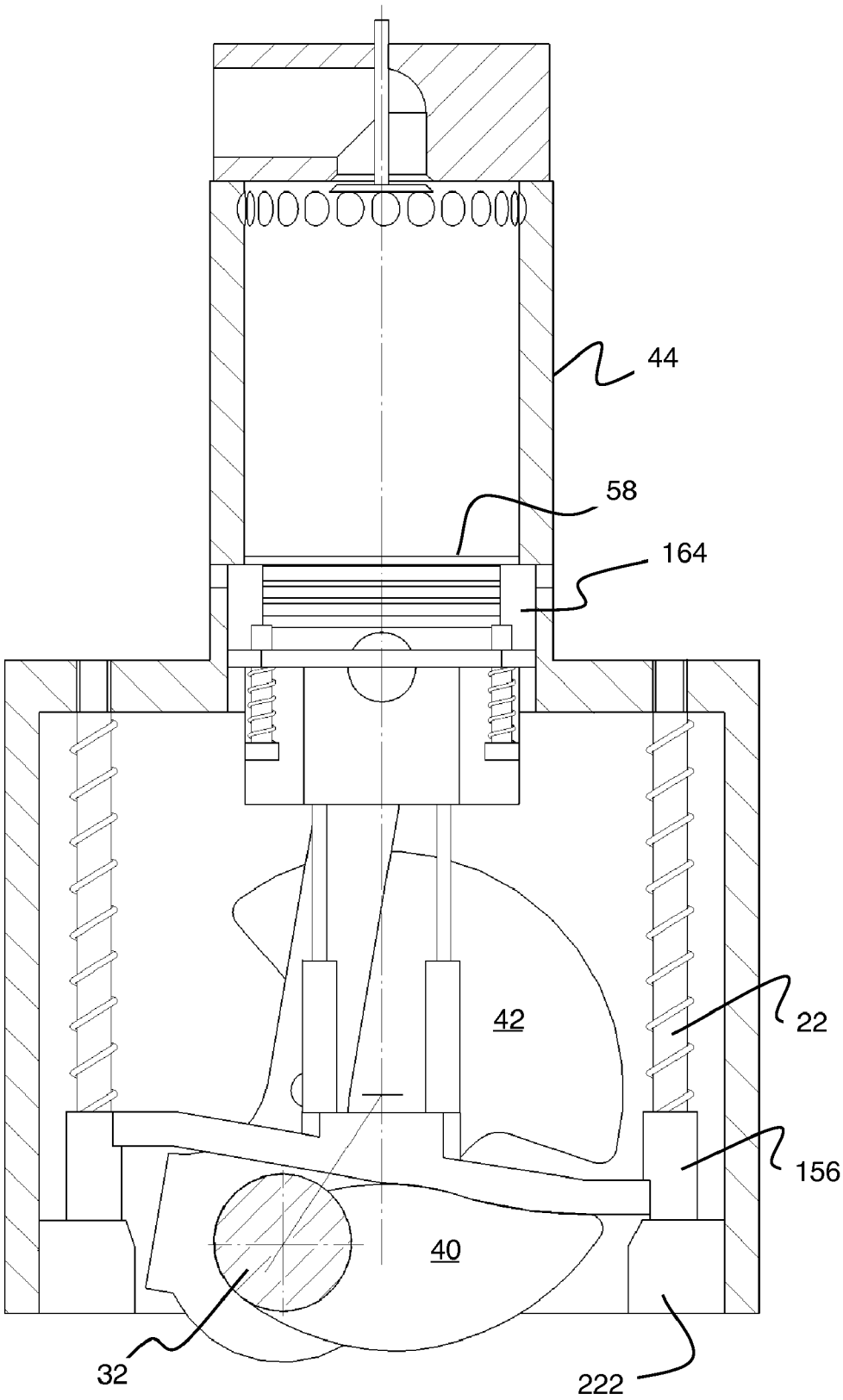
FIG. 30 is a section view of a three stroke engine according to a third embodiment of the present invention.
Figure 31:
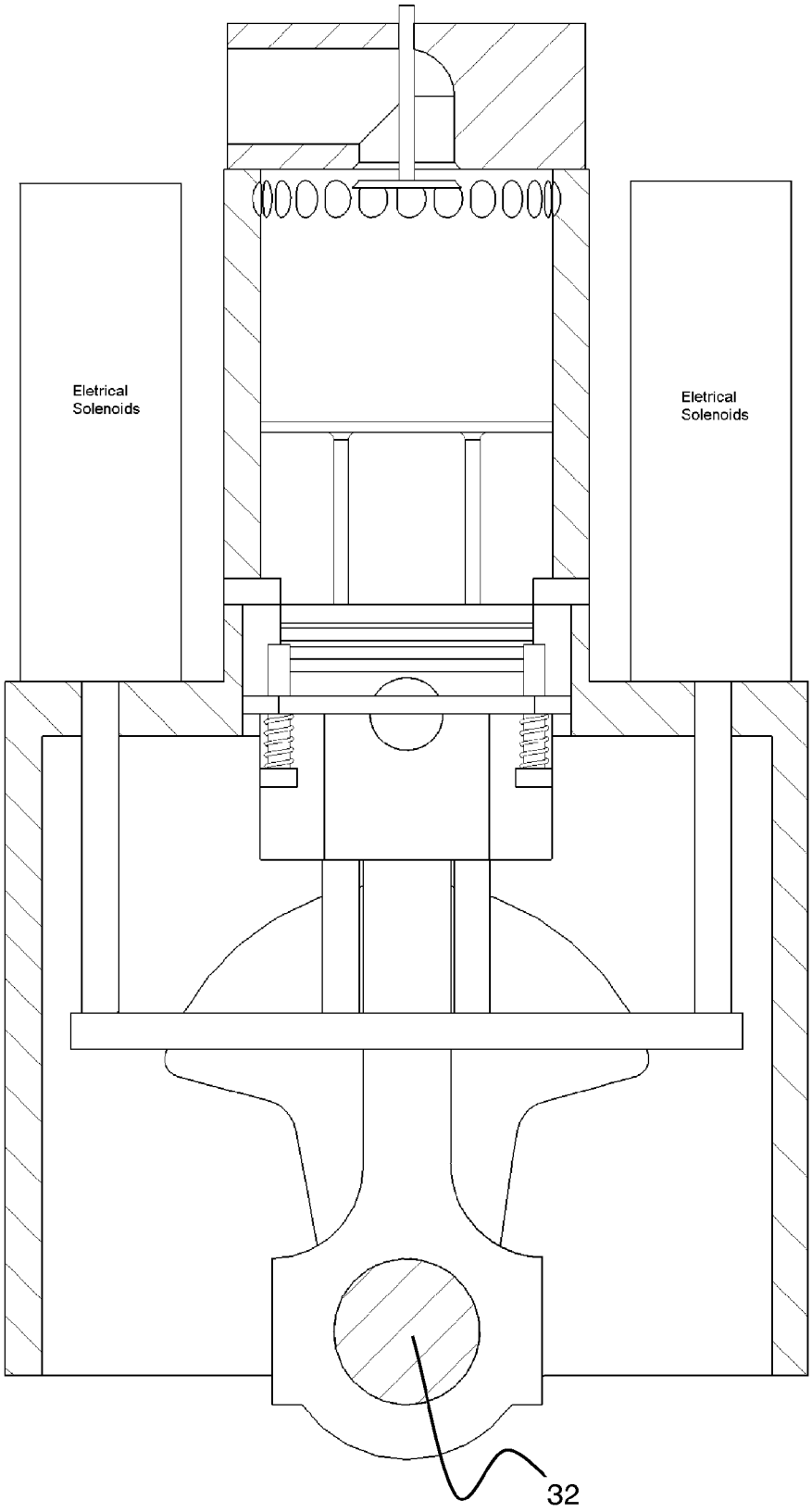
FIG. 31 is a section view of a three stroke engine according to a fourth embodiment of the present invention.

For example, the present invention is not limited to any number or arrangement of cylinders. Rather, three stroke engines can be manufactured in V, opposed cylinder, W, opposed pistons and radial configurations. As a further example, the teachings of the present invention are not limited to spark ignition engines, but can be successfully employed with other reciprocating piston engines, such as diesel engines. As another example, depending on the combustion cycle, the air-fuel mixture can include varying proportions of air, liquid or gaseous fuels, and/or lubricant. As a further example, while the cams are shown as integrally formed with the crankshaft, the cams also can be fixedly or adjustably connected to the crankshaft by bolts or other fasteners. As yet a further example, the lower guide rod springs can be omitted and their function accomplished by dashpots in combination with tension of the upper springs, as shown in FIG. 30. As another example, the cam mounted to the crankshaft can be replaced by solenoids (as shown in FIG. 31), by pneumatic actuators, or by equivalent means for cyclically moving the exhaust-intake piston base. As yet another example, while the embodiment described in detail above includes guide rods for the cam follower base and valve pins for the slide valve, these components equally can be guided by convenient surfaces formed on walls of the block. Parts of the cardioid path can be also omitted. As a further example, although the exhaust-intake piston and the push rods are described above as separate pieces, the exhaust-intake piston and the push rods equally can be manufactured as a single piece.

What is claimed is:

1. A three-stroke internal combustion engine having first and second pistons movably connected to a single crankshaft for reciprocating motion toward and away from each other within a single cylinder during a single revolution of said crankshaft, said single revolution including an exhaust/intake stroke, a compression stroke, and an expansion stroke, said cylinder having a first open end proximate said crankshaft and having inlet ports proximate the first end, and having a second end distant from said crankshaft and closed by a head having formed therein an exhaust passage, said pistons defining therebetween an intake chamber and said second piston defining with the head a combustion chamber, wherein during at least a part of said exhaust-intake stroke, the exhaust passage is open to said combustion chamber, and said crankshaft causes said second piston to move toward the head and away from said first piston, thereby exhausting burned gases from said combustion chamber, and during at least a part of said exhaust-intake stroke, said crankshaft causes said first piston to move away from said second piston, thereby opening the inlet ports to aspirate an air-fuel mixture into said intake chamber;

wherein, during said compression stroke, the exhaust passage and the inlet ports are closed, and said crankshaft causes said first piston to move toward and abut said second piston, thereby forcing the air-fuel mixture past said second piston into said combustion chamber;

wherein, the exhaust passage and said inlet ports remaining closed, ignition of the air-fuel mixture to form burned gases, and consequent expansion of the burned gases in said combustion chamber, causes motion of said pistons away from the head, at least said first piston causing said crankshaft to move through said expansion stroke of said single revolution, said expansion stroke being followed by said exhaust-intake stroke.

2. The three-stroke internal combustion engine according to claim 1, further comprising an igniter disposed in the head.

3. The three-stroke internal combustion engine according to claim 1, wherein an inner wall of said cylinder has at least one axially extending bypass channel formed therein.

4. The three-stroke internal combustion engine according to claim 3, further comprising an injector disposed in said at least one bypass channel.

5. The three-stroke internal combustion engine according to claim 3, said second piston defining a top dead center plane at said second piston's closest approach to the head, said at least one bypass channel extending axially through said top dead center plane.

6. The three-stroke internal combustion engine according to claim 5, said at least one bypass channel extending predominantly axially toward the first end of said cylinder.

7. The three-stroke internal combustion engine according to claim 5, said at least one bypass channel extending predominantly axially toward the second end of said cylinder.

8. A three-stroke internal combustion engine comprising:

an intake manifold having an inner wall with inlet ports formed therein;

a cylinder mounted to the inner wall of the intake manifold, said cylinder having an inner surface extending from a first open end adjacent the intake manifold to a second end closed by a head with an exhaust passage formed therein, said inner surface defining a cylinder axis and including at least one axial bypass channel near said second end;

an exhaust valve disposed within the exhaust passage for opening and sealing the exhaust passage;

a crankshaft rotatably mounted to the cylinder for rotation about a crankshaft axis orthogonal the cylinder axis, said crankshaft including a crank surface in registration with the cylinder axis and further including a cam adjacent to said crank surface;

a connecting rod having upper and lower ends joined by a web, said lower end pivotally connected to the crank surface;

a first piston pivotally connected to the upper end of the connecting rod and slidably movable within the cylinder along the cylinder axis, said first piston defining with the head a compression chamber within the cylinder, and said first piston including holes substantially parallel to the cylinder axis, said holes extending from said compression chamber through said first piston;

a cam follower base disposed between the first piston and the crankshaft so as to be cyclically movable by the cam formed on the crankshaft; and a second piston disposed between the first piston and the head, said second piston being movable along the cylinder axis separately from the first piston, being rigidly connected to the cam follower base by push rods extending through the holes of the first piston, and defining with the first piston a variable volume intake chamber;

wherein rotation of said crankshaft causes said second piston to move toward the head and away from said first piston during an exhaust-intake stroke, causes said first piston to move toward the head and toward said second piston during a compression stroke, and causes said first and second pistons to abut and move together away from the head throughout an expansion stroke.

9. A three-stroke internal combustion engine comprising:

an intake manifold having an inner wall with inlet ports formed therein;

a cylinder mounted to the inner wall of the intake manifold, said cylinder having an inner surface extending from a first open end adjacent the intake manifold to a second end closed by a head with an exhaust passage formed therein, said inner surface defining a cylinder axis and including at least one axial bypass channel near said second end;

an exhaust valve disposed within the exhaust passage for opening and sealing the exhaust passage;

a crankshaft rotatably mounted to the cylinder for rotation about a crankshaft axis orthogonal the cylinder axis, said crankshaft including a crank surface in registration with the cylinder axis and further including a cam adjacent to said crank surface;

a connecting rod having upper and lower ends joined by a web, said lower end pivotally connected to the crank surface;

a first piston pivotally connected to the upper end of the connecting rod and slidably movable within the cylinder along the cylinder axis, said first piston defining with the head a compression chamber within the cylinder, and said first piston including holes substantially parallel to the cylinder axis, said holes extending from said compression chamber through said first piston;

a cam follower base disposed between the first piston and the crankshaft so as to be cyclically movable by the cam formed on the crankshaft; and a second piston disposed between the first piston and the head, said second piston being movable along the cylinder axis separately from the first piston, being rigidly connected to the cam follower base by push rods extending through the holes of the first piston, and defining with the first piston a variable volume intake chamber;

wherein rotation of said crankshaft about said crankshaft axis causes sequential revolution of said crank surface and said cam about said crankshaft axis, such that said connecting rod causes said first piston to move toward the head and toward said second piston during a compression stroke and said cam follower base causes said second piston to move toward the head and away from said first piston during an exhaust-intake stroke, and such that said first and second pistons abut and move together away from the head during an expansion stroke, said crankshaft further including a guide plate having formed therein a cardioid path; and said cam follower base including a protrusion disposed so as to engage said cardioid path during at least part of each rotation of said crankshaft.

10. A three-stroke internal combustion engine comprising:

an intake manifold having an inner wall with inlet ports formed therein;

a cylinder mounted to the inner wall of the intake manifold, said cylinder having an inner surface extending from a first open end adjacent the intake manifold to a second end closed by a head with an exhaust passage formed therein, said inner surface defining a cylinder axis and including at least one axial bypass channel near said second end;

an exhaust valve disposed within the exhaust passage for opening and sealing the exhaust passage;

a crankshaft rotatably mounted to the cylinder for rotation about a crankshaft axis orthogonal the cylinder axis, said crankshaft including a crank surface in registration with the cylinder axis and further including a cam adjacent to said crank surface;

a connecting rod having upper and lower ends joined by a web, said lower end pivotally connected to the crank surface;

a first piston pivotally connected to the upper end of the connecting rod and slidably movable within the cylinder along the cylinder axis, said first piston defining with the head a compression chamber within the cylinder, and said first piston including holes substantially parallel to the cylinder axis, said holes extending from said compression chamber through said first piston;

a cam follower base disposed between the first piston and the crankshaft so as to be cyclically movable by the cam formed on the crankshaft; and a second piston disposed between the first piston and the head, said second piston being movable along the cylinder axis separately from the first piston, being rigidly connected to the cam follower base by push rods extending through the holes of the first piston, and defining with the first piston a variable volume intake chamber;

wherein rotation of said crankshaft about said crankshaft axis causes sequential revolution of said crank surface and said cam about said crankshaft axis, such that said connecting rod causes said first piston to move toward the head and toward said second piston during a compression stroke and said cam follower base causes said second piston to move toward the head and away from said first piston during an exhaust-intake stroke, and such that said first and second pistons abut and move together away from the head during an expansion stroke, said cam follower base having an inward surface facing said connecting rod, the inward surface including a catch formed thereon; and said connecting rod including a protrusion disposed on said connecting rod web so as to engage said catch for downward motion of said cam follower base.

* * * * *